US010621913B2

(12) United States Patent
Furukawa et al.

(10) Patent No.: US 10,621,913 B2
(45) Date of Patent: Apr. 14, 2020

(54) DISPLAY DEVICE AND DRIVING METHOD THEREFOR

(71) Applicant: SHARP KABUSHIKI KAISHA, Sakai, Osaka (JP)

(72) Inventors: Hiroyuki Furukawa, Sakai (JP); Noritaka Kishi, Sakai (JP); Kazuyoshi Yoshiyama, Sakai (JP); Shigetsugu Yamanaka, Sakai (JP); Naoko Goto, Sakai (JP); Tamotsu Sakai, Sakai (JP); Katsuya Otoi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/060,828

(22) PCT Filed: Dec. 13, 2016

(86) PCT No.: PCT/JP2016/086982
§ 371 (c)(1),
(2) Date: Jun. 8, 2018

(87) PCT Pub. No.: WO2017/104631
PCT Pub. Date: Jun. 22, 2017

(65) Prior Publication Data

US 2018/0366061 A1 Dec. 20, 2018

(30) Foreign Application Priority Data

Dec. 14, 2015 (JP) ..... 2015-242848

(51) Int. Cl.
*G09G 3/3233* (2016.01)
*G09G 3/20* (2006.01)
*G09G 3/30* (2006.01)

(52) U.S. Cl.
CPC ..... *G09G 3/3233* (2013.01); *G09G 3/20* (2013.01); *G09G 3/30* (2013.01); *G09G 2320/0295* (2013.01); *G09G 2320/041* (2013.01)

(58) Field of Classification Search
CPC combination set(s) only.
See application file for complete search history.

(56) References Cited

U.S. PATENT DOCUMENTS

2002/0057241 A1 5/2002 Oda et al.
2005/0088379 A1* 4/2005 Tsuchida ..... G09G 3/3258 345/76

(Continued)

FOREIGN PATENT DOCUMENTS

JP 2002-207463 A 7/2002
JP 2009-80252 A 4/2009

(Continued)

*Primary Examiner* — Deeprose Subedi
(74) *Attorney, Agent, or Firm* — ScienBiziP, P.C.

(57) ABSTRACT

An organic EL display device includes: a pixel circuit drive unit configured to drive pixel circuits while performing a property measuring process in which a property of circuit elements is measured; a parameter table configured to store parameter values derived from monitoring data obtained in the property measuring process; a compensation computation unit configured to correct externally provided image data based on the parameter values stored in the parameter table, so as to generate a digital video signal to be fed to the pixel circuits; a temperature sensor configured to sense temperature; and a monitoring control section configured to control an execution frequency of the property measuring process in accordance with the sensed temperature. The monitoring control section increases the execution frequency of the property measuring process with an increase in the sensed temperature.

16 Claims, 21 Drawing Sheets

(56) References Cited

U.S. PATENT DOCUMENTS

| | | | | |
|---|---|---|---|---|
| 2007/0146254 | A1 | 6/2007 | Yanai et al. | |
| 2009/0079727 | A1 | 3/2009 | Ozawa | |
| 2009/0160740 | A1 | 6/2009 | Leon et al. | |
| 2010/0225634 | A1* | 9/2010 | Levey | G09G 3/3208 345/212 |
| 2016/0155377 | A1 | 6/2016 | Kishi | |

FOREIGN PATENT DOCUMENTS

| | | | |
|---|---|---|---|
| JP | 2011-508260 | A | 3/2011 |
| JP | 2012-83777 | A | 4/2012 |
| WO | 2014/208458 | A1 | 12/2014 |

* cited by examiner

DISPLAY DEVICE AND DRIVING METHOD THEREFOR

TECHNICAL FIELD

The following disclosure relates generally to display devices and methods of driving display devices and in particular to display devices including pixel circuits each built around an organic EL (electroluminescence) element or like electro-optical element and methods of driving such display devices.

BACKGROUND ART

Conventional display elements incorporated in display devices may be categorized into electro-optical elements having, for example, their luminance or transmittance controlled through an applied voltage and electro-optical elements having, for example, their luminance or transmittance controlled through a current flow. Typical examples of the former electro-optical elements include liquid crystal display elements, and those of the latter electro-optical elements include organic EL elements, which are also called OLEDs (organic light-emitting diodes). The organic EL display device, incorporating organic EL elements (i.e., self light-emitting electro-optical element), more readily allows for reduced thickness, low power consumption, and high luminance designs and provides other benefits than the liquid crystal display device which requires a backlight and color filters. Organic EL display devices have been actively developed in recent years for these reasons.

The organic EL display device is driven by a passive matrix method (also called a simple matrix method) or an active matrix method, both of which are well known. The organic EL display device driven by a passive matrix method has a simple structure, but is difficult to increase screen size and achieve high definition. In contrast, the organic EL display device driven by an active matrix method (hereinafter, an "active-matrix organic EL display device") is easier to increase screen size and achieve high definition than the organic EL display device driven by a passive matrix method.

An active-matrix organic EL display device includes a matrix of pixel circuits formed therein. Each pixel circuit in the active-matrix organic EL display device typically includes an input transistor through which a pixel is selected and a drive transistor through which a current supply to the organic EL element is controlled. Note that in the following description, the current flow from the drive transistor to the organic EL element may be referred to as the "drive current."

FIG. 23 is a circuit diagram of a configuration of a conventional, typical pixel circuit 91. The pixel circuit 91 is provided at every intersection of data lines S and scan lines G in the display unit. As shown in FIG. 23, the pixel circuit 91 includes two transistors T1 and T2, a capacitor Cst, and an organic EL element OLED. The transistor T1 serves as an input transistor, and the transistor T2 serves as a drive transistor.

The transistor T1 is disposed between the data line S and the gate terminal of the transistor T2. The transistor T1 has its gate terminal connected to the scan line G and its source terminal connected to the data line S. The transistor T2 is disposed in series with the organic EL element OLED. The transistor T2 has its drain terminal connected to a power supply line that feeds a high-level power supply voltage ELVDD and its source terminal connected to the anode terminal of the organic EL element OLED. The power supply line that feeds the high-level power supply voltage ELVDD will hereinafter be referred to as the "high-level power supply line." The high-level power supply line will be denoted by the same reference sign "ELVDD" as the high-level power supply voltage. The capacitor Cst has one of its terminals connected to the gate terminal of the transistor T2 and the other terminal connected to the source terminal of the transistor T2. The organic EL element OLED has its cathode terminal connected to a power supply line that feeds a low-level power supply voltage ELVSS. The power supply line that feeds the low-level power supply voltage ELVSS will hereinafter be referred to as the "low-level power supply line." The low-level power supply line will be denoted by the same reference sign "ELVSS" as the low-level power supply voltage. Also, in this description, the node where the gate terminal of the transistor T2, a terminal of the capacitor Cst, and the drain terminal of the transistor T1 are connected will be referred to as a "gate node" for convenience and denoted by a reference sign "VG" Usually, either the drain or the source that has a higher potential is termed the drain. In this specification, however, one of them is defined as the drain, and the other as the source; the source potential may be in some cases higher than the drain potential.

FIG. 24 is a timing chart depicting an operation of the pixel circuit 91 shown in FIG. 23. The scan line G is not selected until time t01. Therefore, until time t01, the transistor T1 is off, thereby maintaining the gate node VG at an initial potential level (e.g., a level that is in accordance with the writing in the preceding frame). At time t01, the scan line G is selected, thereby turning on the transistor T1. Accordingly, a data voltage Vdata that corresponds to the luminance of the pixel (subpixel) formed by the pixel circuit 91 is supplied to the gate node VG via the data line S and the transistor T1. Thereafter, the potential at the gate node VG changes in accordance with the data voltage Vdata in the period up to time t02. In that period, the capacitor Cst is charged to a gate-to-source voltage Vgs which is a difference between the potential at the gate node VG and the source potential of the transistor T2. At time t02, the scan line G is deselected. In response to this, the transistor T1 is turned off, establishing the gate-to-source voltage Vgs to be maintained by the capacitor Cst. The transistor T2 feeds the organic EL element OLED with a drive current that matches the gate-to-source voltage Vgs maintained by the capacitor Cst. As a result, the organic EL element OLED emits light at a luminance that matches the drive current.

The organic EL display device typically includes thin film transistors (TFTs) as drive transistors. However, thin film transistors tend to vary in threshold voltage from one to the other. The numerous drive transistors in the display unit, having various threshold voltages, will cause variable luminance, which degrades display quality. In addition, the drive transistor and the organic EL element exhibit voltage-current characteristics that degrade over time, thereby allowing a current flow to decrease over time even under the same applied voltage. The luminance of the organic EL element therefore decreases gradually over time. Furthermore, the organic EL element has a light emission efficiency that decreases over time. Therefore, even if the organic EL element is supplied with a fixed current, its luminance decreases over time. These phenomena cause image sticking. To address these issues, processes have been suggested and implemented that compensate for the variations and adverse changes of the threshold voltage of drive transistors and the degradation (including decreases of the light emission efficiency over time) of organic EL elements.

It is noted here that in relation to the present invention, some documents are known as will be briefly described here. PCT International Application Publication, No. WO2014/208458 discloses an invention of an organic EL display device in which properties (characteristics) of both the drive transistor and the organic EL element are detected so that the organic EL element can be supplied with a drive current that compensates for both the degradation of the drive transistor and the degradation of the organic EL element. Japanese Unexamined Patent Application Publication, Tokukai, No. 2012-83777 discloses an invention of a light-emitting device in which changes that occur in the electrode potential of a monitoring element (light-emitting element provided for the purpose of monitoring) as a result of temperature changes and device degradation over time are fed back to the light-emitting elements to maintain the luminance of the light-emitting elements at a fixed value. Japanese Unexamined Patent Application Publication, Tokukai, No. 2009-80252 discloses an invention of an organic EL display device in which the signal amplitude reference voltage (the voltage that is in the video signal amplitude and determines the black level) and the signal value reference voltage for determining an amplitude for a signal value fed to a pixel circuit are varied with sensed temperature to compensate for temperature-dependent luminance variations while maintaining high image quality.

CITATION LIST

Patent Literature

Patent Literature 1: PCT International Application Publication, No. WO2014/208458

Patent Literature 2: Japanese Unexamined Patent Application Publication, Tokukai, No. 2012-83777

Patent Literature 3: Japanese Unexamined Patent Application Publication, Tokukai, No. 2009-80252

SUMMARY OF INVENTION

Technical Problem

The organic EL element has a temperature-dependent luminance (luminance of emitted light). FIG. 25 is a graphical representation of the voltage-current characteristics of an organic EL element. The curve denoted by a reference numeral "92" represents the voltage-current characteristics at a relatively low temperature, and the curve denoted by a reference numeral "93" represents the voltage-current characteristics at a relatively high temperature. As can be understood from FIG. 25, the organic EL element allows a current flow to increase with an increase in temperature under the same applied voltage. That indicates that the luminance of the organic EL element increases with an increase in temperature. The organic EL element has this short-term property that the luminance increases with an increase in temperature.

Whereas the organic EL element has a luminance that increases with an increase in temperature in short terms as described above, the luminance decreases with an increase in temperature in long terms because the organic EL element degrades more at higher temperature under the stress caused by the temperature. These phenomena will be described next in reference to FIG. 26. FIG. 26 is a graph prepared for the purpose of discussion of a long-term property of the organic EL element. In FIG. 26, the horizontal axis is time, and the vertical axis is the luminance of the organic EL element. The straight line denoted by a reference numeral "94" represents a time-luminance relationship at a relatively low temperature, and the straight line denoted by a reference numeral "95" represents a time-luminance relationship at a relatively high temperature. It will be appreciated from FIG. 26 that the luminance of the organic EL element decreases with time regardless of temperature. It will also be appreciated from FIG. 26 that the luminance decreases more quickly at higher temperature. The organic EL element has this long-term property that the luminance decreases more quickly at higher temperature due to temperature-induced degradation as discussed here.

Since the organic EL element has these short- and long-term properties, it follows that if compensation is done in a high temperature environment by taking only the short-term property into consideration, so as to reduce luminance (to reduce the current flow through the organic EL element), the luminance will become too low (the organic EL element will become too dark) with passage of time.

PCT International Application Publication, No. WO2014/208458 discloses an organic EL display device in which compensation is done for both the degradation of drive transistors and the degradation of organic EL elements. However, unless the circuit elements (drive transistors and organic EL elements) are monitored to detect their properties (i.e., to measure current or voltage) at properly specified intervals, the luminance could decrease due to temperature-induced degradation. Monitoring at an increased frequency will result in increased power consumption. Meanwhile, there has been growing demand to reduce power consumption of, especially, mobile display devices because the time that users use such devices is rapidly increasing.

In view of these issues, the following disclosure has an object to provide a display device capable of restraining luminance from decreasing due to temperature-induced degradation (falling light emission efficiency) of electro-optical elements (typically, organic EL elements) without entailing significant increase in power consumption.

Solution to Problem

The present invention, in a first aspect thereof, is directed to a display device including a plurality of pixel circuits each including, as circuit elements: an electro-optical element having a current-controlled luminance; and a drive transistor for controlling a current to be fed to the electro-optical element, the display device including: a pixel circuit drive unit configured to perform a property measuring process in which a property of the circuit elements is measured and a drive process in which the pixel circuits are driven; a property data memory unit configured to store property data obtained from a result of measurement performed in the property measuring process; a compensation computation unit configured to correct an input video signal based on the property data stored in the property data memory unit, so as to generate a video signal to be fed to the pixel circuits; at least one temperature sensing unit configured to sense temperature; and a measurement controlling unit configured to control an execution frequency of the property measuring process in accordance with a temperature sensed by the at least one temperature sensing unit, wherein the measurement controlling unit increases the execution frequency of the property measuring process with an increase in the sensed temperature.

In a second aspect of the present invention, the first aspect of the present invention is characterized in that the measurement controlling unit stores in advance a first relationship equation representing a relationship between temperature and the execution frequency of the property measuring process, so that the execution frequency of the property measuring process is determined based on the sensed temperature using the first relationship equation.

In a third aspect of the present invention, the first aspect of the present invention is characterized in that the display device further includes a cumulative drive time measurement unit configured to measure a cumulative drive time of the pixel circuits, wherein the measurement controlling unit increases the execution frequency of the property measuring process with a decrease in the cumulative drive time.

In a fourth aspect of the present invention, the third aspect of the present invention is characterized in that the measurement controlling unit stores in advance a second relationship equation representing a relationship between the cumulative drive time and the execution frequency of the property measuring process, so that the execution frequency of the property measuring process is determined based on the cumulative drive time using the second relationship equation.

In a fifth aspect of the present invention, the first aspect of the present invention is characterized in that the display device further includes: a first property data correction section configured to correct a value of the property data obtained from the result of measurement performed in the property measuring process to a value associated with standard temperature based on a temperature sensed in the property measuring process by the at least one temperature sensing unit, so as to store corrected property data in the property data memory unit; and a second property data correction section configured to correct a value of the property data stored in the property data memory unit to a value associated with a temperature sensed in the drive process by the at least one temperature sensing unit, wherein the compensation computation unit corrects the input video signal based on property data corrected by the second property data correction section, so as to generate a video signal to be fed to the pixel circuits.

In a sixth aspect of the present invention, the first aspect of the present invention is characterized in that the at least one temperature sensing unit includes a plurality of temperature sensing units.

In a seventh aspect of the present invention, the first aspect of the present invention is characterized in that the at least one temperature sensing unit is disposed inside a display panel containing the pixel circuits.

In an eighth aspect of the present invention, the first aspect of the present invention is characterized in that the at least one temperature sensing unit is disposed outside a display panel containing the pixel circuits.

In a ninth aspect of the present invention, the first aspect of the present invention is characterized in that the electro-optical element is an organic light-emitting diode.

The present invention, in a tenth aspect thereof, is directed to a method of driving a display device including a plurality of pixel circuits each including, as circuit elements: an electro-optical element having a current-controlled luminance; and a drive transistor for controlling a current to be fed to the electro-optical element, the method including: the pixel circuit driving step of driving the pixel circuits while performing a property measuring process in which a property of the circuit elements is measured; the property data storing step of storing property data obtained from a result of measurement performed in the property measuring process in a prescribed property data memory unit; the compensation computing step of correcting an input video signal based on the property data stored in the property data memory unit, so as to generate a video signal to be fed to the pixel circuits; the temperature sensing step of sensing temperature; and the measurement controlling step of controlling an execution frequency of the property measuring process in accordance with a temperature sensed in the temperature sensing step, wherein the measurement controlling step increases the execution frequency of the property measuring process with an increase in the sensed temperature.

The present invention, in an eleventh aspect thereof, is directed to a display device including a plurality of pixel circuits each including, as circuit elements: an electro-optical element having a current-controlled luminance; and a drive transistor for controlling a current to be fed to the electro-optical element, said display device including: a pixel circuit drive unit configured to perform a property measuring process in which a property of the circuit elements is measured and a drive process in which the pixel circuits are driven; a property data memory unit; at least one temperature sensing unit configured to sense temperature; a first property data correction section configured to correct a value of property data obtained from a result of measurement performed in the property measuring process to a value associated with standard temperature based on a temperature sensed in the property measuring process by the at least one temperature sensing unit, so as to store corrected property data in the property data memory unit a second property data correction section configured to correct a value of the property data stored in the property data memory unit to a value associated with a temperature sensed in the drive process by the at least one temperature sensing unit; and a compensation computation unit configured to correct an input video signal based on the property data corrected by the second property data correction section, so as to generate a video signal to be fed to the pixel circuits.

In a twelfth aspect of the present invention, the eleventh aspect of the present invention is characterized in that the at least one temperature sensing unit comprises a plurality of temperature sensing units.

In a thirteenth aspect of the present invention, the eleventh aspect of the present invention is characterized in that the at least one temperature sensing unit is disposed inside a display panel containing the pixel circuits.

In a fourteenth aspect of the present invention, the eleventh aspect of the present invention is characterized in that the at least one temperature sensing unit is disposed outside a display panel containing the pixel circuits.

In a fourteenth aspect of the present invention, the eleventh aspect of the present invention is characterized in that the electro-optical element is an organic light-emitting diode.

Advantageous Effects of Invention

According to the first aspect of the present invention, a display device having a function of compensating for degradation of circuit elements (electro-optical elements and drive transistors) includes: a temperature sensing unit that senses temperature; and a measurement controlling unit that controls the execution frequency of a property measuring process (current monitoring and/or voltage monitoring performed to obtain a property of circuit elements) in accordance with sensed temperature. The measurement controlling unit then adjusts the execution frequency of the property measuring process such that the execution frequency increases with an increase in the sensed temperature and decreases with a decrease in the sensed temperature. This configuration restrains luminance from decreasing due to temperature-induced degradation even when the display device is being used at high temperature. In addition, although power consumption increases with an increasing execution frequency of the property measuring process, the configuration lowers the execution frequency of the property measuring process at low temperature. That restrains power consumption from increasing due to the property measuring process. In this manner, the first aspect of the present invention provides a display device capable of restraining luminance from decreasing due to temperature-induced degradation (falling light emission efficiency) of electro-optical elements without entailing significant increase in power consumption.

The second aspect of the present invention enables compensation computation considering various factors including the material and manufacturing process of the circuit elements, thereby more reliably achieving the same effects as those achieved by the first aspect of the present invention.

According to the third aspect of the present invention, the display device includes a cumulative drive time measurement unit that measures a cumulative drive time of the pixel circuits. The execution frequency of the property measuring process is then determined considering a cumulative drive time of the pixel circuits as well as temperature. Therefore, the execution frequency of the property measuring process is determined in a more suitable manner in accordance with a cumulative drive time of the pixel circuits. Hence, the third aspect of the present invention provides a display device capable of more effectively restraining luminance from decreasing due to temperature-induced degradation (falling light emission efficiency) of electro-optical elements while more effectively suppressing increases in power consumption.

The fourth aspect of the present invention enables compensation computation considering various factors including the material and manufacturing process of the circuit elements, thereby more reliably achieving the same effects as those achieved by the third aspect of the present invention.

According to the fifth aspect of the present invention, the property data obtained in the property measuring process is stored in the property data memory unit after the value of the property data is converted to a value that the property data will take at standard temperature. The value of the property data stored in the property data memory unit is then subjected to a correction in which that value is converted to a value associated with a temperature at which compensation computation is performed. An input video signal is corrected on the basis of the corrected property data. Property data is stored after its value is temporarily converted a value associated with standard temperature in this manner. Therefore, precision of compensation can be maintained even when temperature varies by large amounts.

The sixth aspect of the present invention enables sufficient compensation for degradation of the circuit elements no matter where the circuit elements are located in the display panel.

According to the seventh aspect of the present invention, the temperature sensing unit senses temperature close to the circuit elements, which improves precision of compensation.

According to the eighth aspect of the present invention, the temperature sensing unit may be a common sensor. In addition, the display panel may have a conventional configuration with no modifications. Therefore, the eighth aspect of the present invention is capable of lowering cost over the configuration in which the temperature sensing unit is provided inside the display panel.

The ninth aspect of the present invention provides an organic EL display device capable of restraining luminance from decreasing due to temperature-induced degradation (falling light emission efficiency) of electro-optical elements without entailing significant increase in power consumption.

According to the tenth aspect of the present invention, the method of driving a display device achieves the same effects as those achieved by the first aspect of the present invention.

According to the eleventh to fifteenth aspect of the present invention, the same effects as those achieved by the fifth to ninth aspect of the present invention are achieve.

DESCRIPTION OF EMBODIMENTS

The following will describe an embodiment of the present invention in reference to attached drawings. Throughout the following description, M and N each denote an integer greater than or equal to 2, i an integer from 1 to N inclusive, and j an integer from 1 to M inclusive. Also throughout the following description, the characteristics of a drive transistor in a pixel circuit are referred to as the "TFT characteristics," and the characteristics of an organic EL element in a pixel circuit as the "OLED characteristics."

1. OVERALL CONFIGURATION

Figure 1:
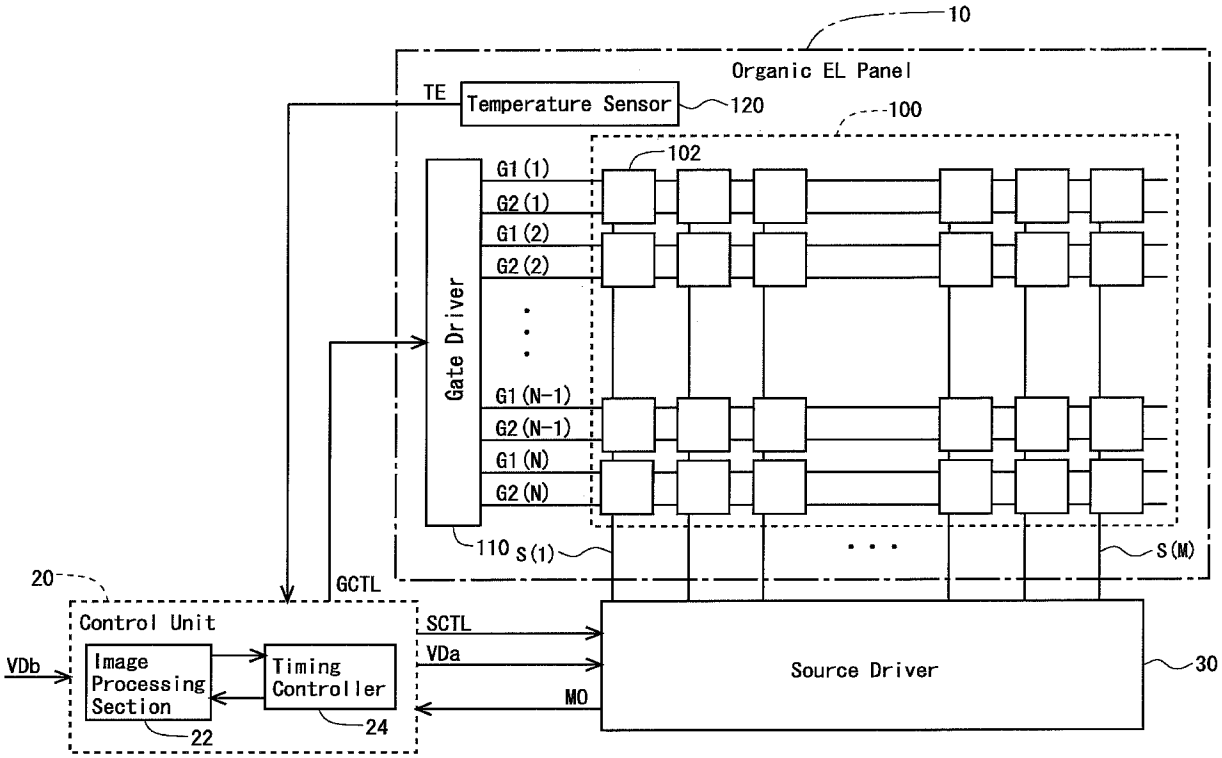
FIG. 1 is a block diagram of an overall configuration of an active-matrix organic EL display device in accordance with an embodiment of the present invention.

FIG. 1 is a block diagram of an overall configuration of an active-matrix organic EL display device in accordance with an embodiment of the present invention. The organic EL display device includes an organic EL panel 10, a control unit 20, and a source driver 30. The organic EL panel 10 includes a display unit 100, a gate driver 110, and a temperature sensor 120. To put it differently, in the present embodiment, the gate driver 110 is provided on a substrate that is a part of the organic EL panel 10. Alternatively, the gate driver 110 may be provided outside the organic EL panel 10. The control unit 20 includes an image processing section 22 and a timing controller 24. The image processing section 22 is built around an LSI generally called a "GPU." The timing controller 24 is built around an LSI generally called "TCON" to control the operation of the gate driver 110 and the source driver 30. The image processing section 22 and the timing controller 24, although being realized using two distinct LSIs as described here, will be collectively referred to as the control unit 20 for convenience in the present specification. Also in the present embodiment, the gate driver 110 and the source driver 30 provide a pixel circuit drive unit, and the temperature sensor 120 provides a temperature sensing unit.

The display unit 100 includes M data lines S(1) to S(M) and N scan lines G1(1) to G1(N) disposed at right angles. The display unit 100 further includes N monitoring control lines G2(1) to G2(N) each for a different one of the N scan lines G(1) to G1(N). The scan lines G1(1) to G1(N) are parallel to the monitoring control lines G2(1) to G2(N). The display unit 100 further includes N×M pixel circuits 102 at the intersections of the N scan lines G1(1) to G1(N) and the M data lines S(1) to S(M). The N×M pixel circuits 102, arranged in this manner, form a pixel matrix of N rows and M columns in the display unit 100. The display unit 100 further includes a high-level power supply line (not shown) to supply a high-level power supply voltage and a low-level power supply line (not shown) to supply a low-level power supply voltage.

Throughout the following description, the M data lines S(1) to S(M) will be denoted simply by a reference sign "S" when there is no need to distinguish between the individual data lines. Likewise, the N scan lines G1(1) to G1(N) will be denoted simply by a reference sign "G1" when there is no need to distinguish between the individual scan lines, and the N monitoring control lines G2(1) to G2(N) will be denoted simply by a reference sign "G2" when there is no need to distinguish between the individual monitoring control lines.

Each data line S in the present embodiment is used not only as a signal line through which a luminance signal (video signal) is transmitted to cause the organic EL element in the pixel circuit 102 to emit light at a desired luminance, but also as a signal line through which a voltage is delivered to the pixel circuit 102 to detect TFT and OLED characteristics (hereinafter, a "measuring voltage") and as a signal line that serves as a path for a current representing TFT and OLED characteristics that is measurable by a current monitoring section 320 (details will be given later).

The following will describe an operation of the constituent elements shown in FIG. 1. The temperature sensor 120 senses its ambient temperature and outputs temperature data TE that represents the sensed temperature. There may be provided any number of temperature sensors 120. Taking non-uniform temperature distribution in the organic EL panel 10 into consideration, however, it is preferable that there be provided a plurality of temperature sensors 120.

The control unit 20 receives externally provided image data VDb, monitoring data MO outputted from the source driver 30, and the temperature data TE outputted from the temperature sensor 120. The control unit 20 then subjects the image data VDb to compensation computation (detailed later) on the basis of the monitoring data MO and the temperature data TE to generate a digital video signal (compensated image data) VDa for output to the source driver 30. The monitoring data MO is obtained through measurement performed to detect TFT and OLED characteristics. The control unit 20 also controls the operation of the source driver 30 by supplying the digital video signal VDa and a source control signal SCTL to the source driver 30 and controls the operation of the gate driver 110 by supplying a gate control signal GCTL to the gate driver 110. The source control signal SCTL includes, for example, a source start pulse signal, a source clock signal, and a latch strobe signal. The gate control signal GCTL includes, for example, a gate start pulse signal, a gate clock signal, and an output enable signal. The digital video signal VDa, the source control signal SCTL, and the gate control signal GCTL are in typical cases outputted from the timing controller 24 in the control unit 20.

The gate driver 110 is connected to the N scan lines G1(1) to G1(N) and the N monitoring control lines G2(1) to G2(N). The gate driver 110 is composed primarily of shift registers and logic circuits. The gate driver 110 drives the N scan lines G1(1) to G1(N) and the N monitoring control lines G2(1) to G2(N) on the basis of the gate control signal GCTL outputted from the control unit 20.

Figure 2:
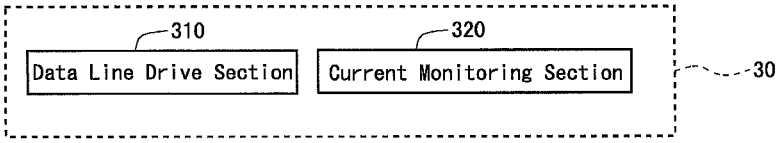
FIG. 2 is a schematic of a source driver in accordance with the embodiment.

The source driver 30 is connected to the M data lines S(1) to S(M). The source driver 30 selectively drives the data lines S(1) to S(M) and measures currents flowing through the data lines S(1) to S(M). In functional terms, the source driver 30 includes a portion that functions as a data line drive section 310 that drives the data lines S(1) to S(M) and a portion that functions as the current monitoring section 320 that measures the currents outputted from the pixel circuits 102 to the data lines S(1) to S(M), as shown in FIG. 2. The current monitoring section 320 measures currents flowing through the data lines S(1) to S(M) and outputs the monitoring data MO based on these measured values.

The N scan lines G1(1) to G1(N), the N monitoring control lines G2(1) to G2(N), and the M data lines S(1) to S(M) are driven as described above, so that the display unit 100 can display an image based on the externally provided image data VDb. In this particular process, the image data VDb is subjected to compensation computation on the basis of the monitoring data MO and the temperature data TE to compensate for variations in the threshold voltages of the drive transistors and the degradation of the organic EL elements.

2. PIXEL CIRCUITS AND SOURCE DRIVER

Next, the pixel circuits 102 and the source driver 30 will be described in more detail. The source driver 30, when functioning as the data line drive section 310, operates as in the following. The source driver 30 receives the source control signal SCTL outputted from the control unit 20 and applies voltages (hereinafter, "data voltages") in accordance with target luminances to the M data lines S(1) to S(M) respectively. Triggered by pulses on the source start pulse signal, the source driver 30 sequentially latches the digital video signal VDa, which represents voltages to be applied to the data lines S, upon appearance of pulses on the source clock signal. Then, upon appearance of pulses on the latch strobe signal, the latched digital video signal VDa is converted to analog voltages. The resultant analog voltages are applied simultaneously to all the data lines S(1) to S(M) as data voltages. The source driver 30, when functioning as the current monitoring section 320, applies measuring voltages to the data lines S(1) to S(M) to convert the currents flowing through the data lines S(1) to S(M) to voltages. The resultant data is outputted as the monitoring data MO from the source driver 30.

Figure 3:
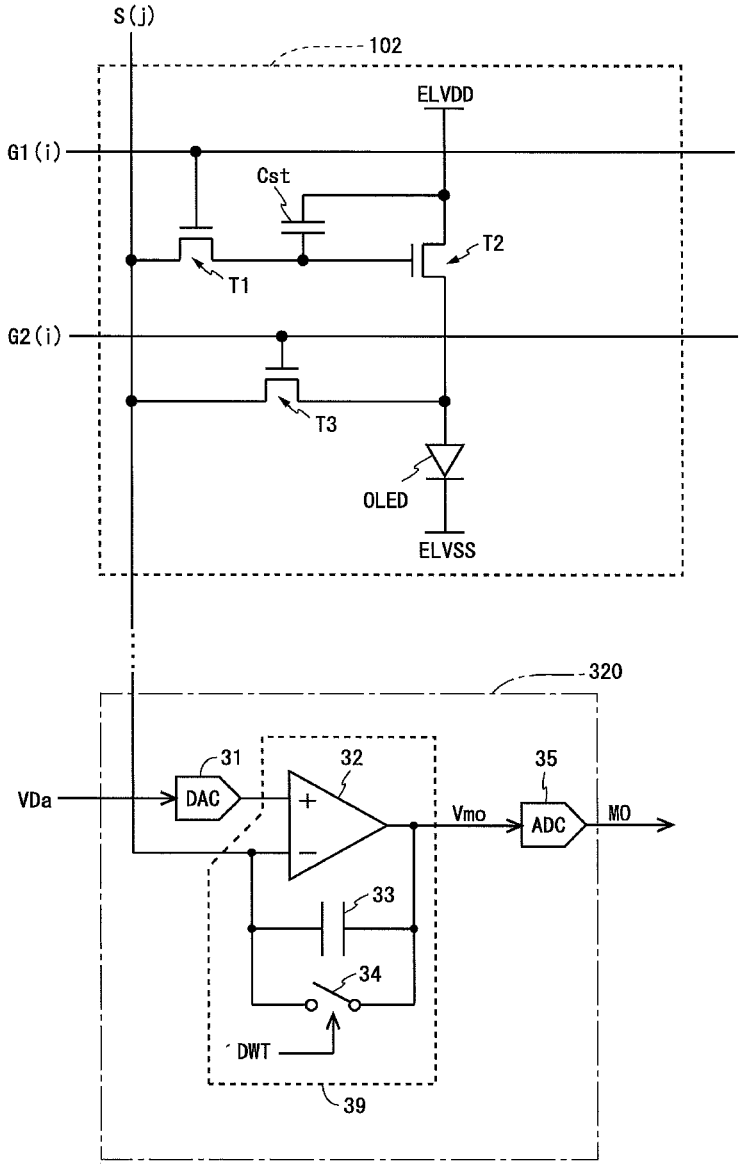
FIG. 3 is a circuit diagram of a pixel circuit and a portion of a source driver (that functions as a current monitoring section) in accordance with the embodiment.

FIG. 3 is a circuit diagram of one of the pixel circuits 102 and a portion of the source driver 30 (that functions as the current monitoring section 320). FIG. 3 shows one of the pixel circuits 102 that is located in the i-th row, j-th column and the portion of the source driver 30 that is associated with the data line S(j) in the j-th column. The pixel circuit 102 includes an organic EL element (electro-optical element) OLED, three transistors T1 to T3, and a capacitor Cst. The transistor T1 functions as an input transistor through which a pixel is selected. The transistor T2 functions as a drive transistor through which a current supply to the organic EL element OLED is controlled. The transistor T3 functions as a monitoring control transistor through which it is controlled whether to perform current measurement to detect characteristics of the drive transistor T2 or the organic EL element OLED.

The transistor T1 is disposed between the data line S(j) and the gate terminal of the transistor T2. The transistor T1 has its gate terminal connected to the scan line G1(*i*) and its source terminal connected to the data line S(j). The transistor T2 is disposed in series with the organic EL element OLED. The transistor 12 has its gate terminal connected to the drain terminal of the transistor T1, its drain terminal connected to a high-level power supply line ELVDD, and its source terminal connected to the anode terminal of the organic EL element OLED. The transistor T3 has its gate terminal connected to the monitoring control line G2(*i*), its drain terminal connected to the anode terminal of the organic EL element OLED, and its source terminal connected to the data line S(j). The capacitor Cst has one of its terminals connected to the gate terminal of the transistor T2 and the other terminal connected to the drain terminal of the transistor T2. The cathode terminal of the organic EL element OLED is connected to a low-level power supply line ELVSS. The transistors T1 to T3 in the pixel circuit 102 may be, for example, oxide TFTs (thin film transistors containing an oxide semiconductor in the channel layer) or amorphous silicon TFTs. The oxide TFTs may be, for example, TFTs that contain InGaZnO (indium gallium zinc oxide). The use of oxide TFTs allows for high definition and reduced power consumption, for example.

As shown in FIG. 3, the current monitoring section 320 includes a D/A converter (DAC) 31, an operational amplifier 32, a capacitor 33, a switch 34, and an A/D converter (ADC) 35. The operational amplifier 32, the capacitor 33, and the switch 34 constitute a current/voltage conversion section 39. Note that the current/voltage conversion section 39 and the D/A converter 31 double as constituent elements of the data line drive section 310.

The digital video signal VDa is supplied to the input terminal of the D/A converter 31, which then converts the digital video signal VDa to an analog voltage that serves as either a data voltage or a measuring voltage. The output terminal of the D/A converter 31 is connected to the non-inverted input terminal of the operational amplifier 32. Therefore, the data voltage or the measuring voltage is supplied to the non-inverted input terminal of the operational amplifier 32. The inverted input terminal of the operational amplifier 32 is connected to the data line S(j). The switch 34 is disposed between the inverted input terminal and output terminal of the operational amplifier 32. The capacitor 33 is disposed in parallel with the switch 34, between the inverted input terminal and output terminal of the operational amplifier 32. The control terminal of the switch 34 is fed with an input/output control signal DWT contained in the source control signal SCTL. The output terminal of the operational amplifier 32 is connected to the input terminal of the A/D converter 35.

In this configuration, when the input/output control signal DWT is HIGH, the switch 34 is on, and the inverted input terminal and output terminal of the operational amplifier 32 are short-circuited. Under these conditions, the operational amplifier 32 functions as a buffer amplifier. Consequently, the data line S(j) is fed with the voltage (data voltage or measuring voltage) that is supplied to the non-inverted input terminal of the operational amplifier 32. When the input/output control signal DWT is LOW, the switch 34 is oft and the inverted input terminal and output terminal of the operational amplifier 32 are connected via the capacitor 33. Under these conditions, the operational amplifier 32 and the capacitor 33 function as an integration circuit. Consequently, the output voltage (monitoring voltage Vmo) of the operational amplifier 32 is matched with the current flowing through the data line S(j). The A/D converter 35 converts the output voltage (monitoring voltage Vmo) of the operational amplifier 32 to a digital value. The resultant data is fed to the control unit 20 as the monitoring data MO.

In the present embodiment, a common signal line is used to both supply a data voltage and measure a current, which by no means limits the scope of the present invention. Alternatively, separate signal lines may be provided to supply a data voltage and measure a current. Furthermore, the pixel circuit 102 may have an arrangement other than the one shown in FIG. 3. In other words, the present invention is not particularly limited by any specific circuit arrangement of; for example, the current monitoring section 320 and the pixel circuit 102.

3. DRIVING METHOD

Next will be described a driving method for current monitoring (measurement of currents to detect TFT and OLED characteristics). Currents may be monitored in any period including a display period, a vertical blanking period, a period immediately following a turn-on of a device, or a period immediately preceding a turn-off of a device. In the following description, the period in which a series of processes are carried out for current monitoring will be referred to as a "monitoring period." Also in the following description, the row on which current monitoring is being performed will be referred to as the "monitored row."

Figure 4:
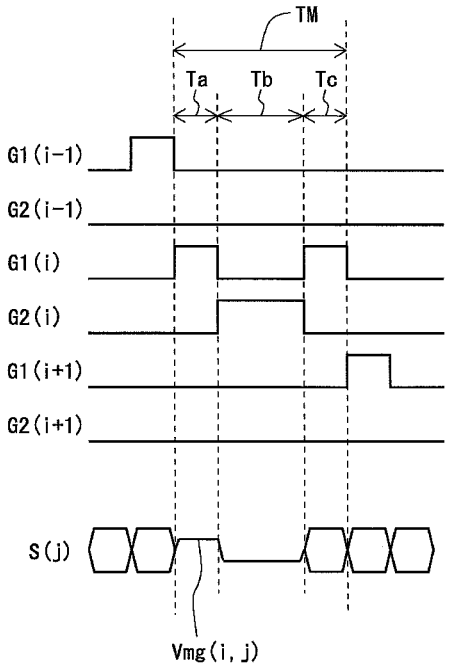
FIG. 4 is a timing chart depicting a driving method for current monitoring in accordance with the embodiment.

FIG. 4 is a timing chart depicting a driving method for current monitoring. In FIG. 4, current monitoring is being performed on the i-th row as an example. The period denoted by a reference sign "TM" in FIG. 4 is a monitoring period. Each monitoring period TM includes a period, Ta, in which preparation is done to detect TFT or OLED characteristics in the monitored row (hereinafter, a "detection preparation period"), a period, Tb, in which current is measured to detect the characteristics (hereinafter, a "current measuring period"), and a period, Tc, in which data voltage is written in the monitored row (hereinafter, a "data voltage writing period").

Throughout the detection preparation period Ta, the scan line G1(*i*) is active, and the monitoring control line G2(*i*) is inactive. Therefore, the transistor T1 is on, and the transistor T3 is oft throughout the period. In the detection preparation period Ta, the data line S(j) is fed with a measuring voltage Vmg(i,j). Note that the measuring voltage Vmg(i,j) is not fixed and has different values when TFT characteristics are to be detected and when OLED characteristics are to be detected. In other words, the "measuring voltage" here comprehensively refers to a TFT characteristics measuring voltage and an OLED characteristics measuring voltage. When the measuring voltage Vmg(i,j) is a TFT characteristics measuring voltage, the transistor T2 is on; when the measuring voltage Vmg(i,j) is an OLED characteristics measuring voltage, the transistor T2 is off.

The TFT characteristics measuring voltage applied to the data line S(j) in the detection preparation period Ta is set so as to satisfy the inequality: TFT Characteristics Measuring Voltage<Threshold Voltage of Organic EL Element OLED+Threshold Voltage of Transistor T2. This setting inhibits current from flowing through the organic EL element OLED in the current measuring period Tb, thereby enabling the characteristics of the transistor T2 to be measured exclusively. The OLED characteristics measuring voltage applied to the data line S(j) in the detection preparation period Ta is set so as to satisfy the inequality: OLED Characteristics Measuring Voltage<Threshold Voltage of Organic EL Element OLED+Threshold Voltage of Transistor T2. This setting inhibits the transistor T2 from being turned on in the current measuring period Tb, thereby enabling the characteristics of the organic EL element OLED to be measured exclusively.

Figure 5:
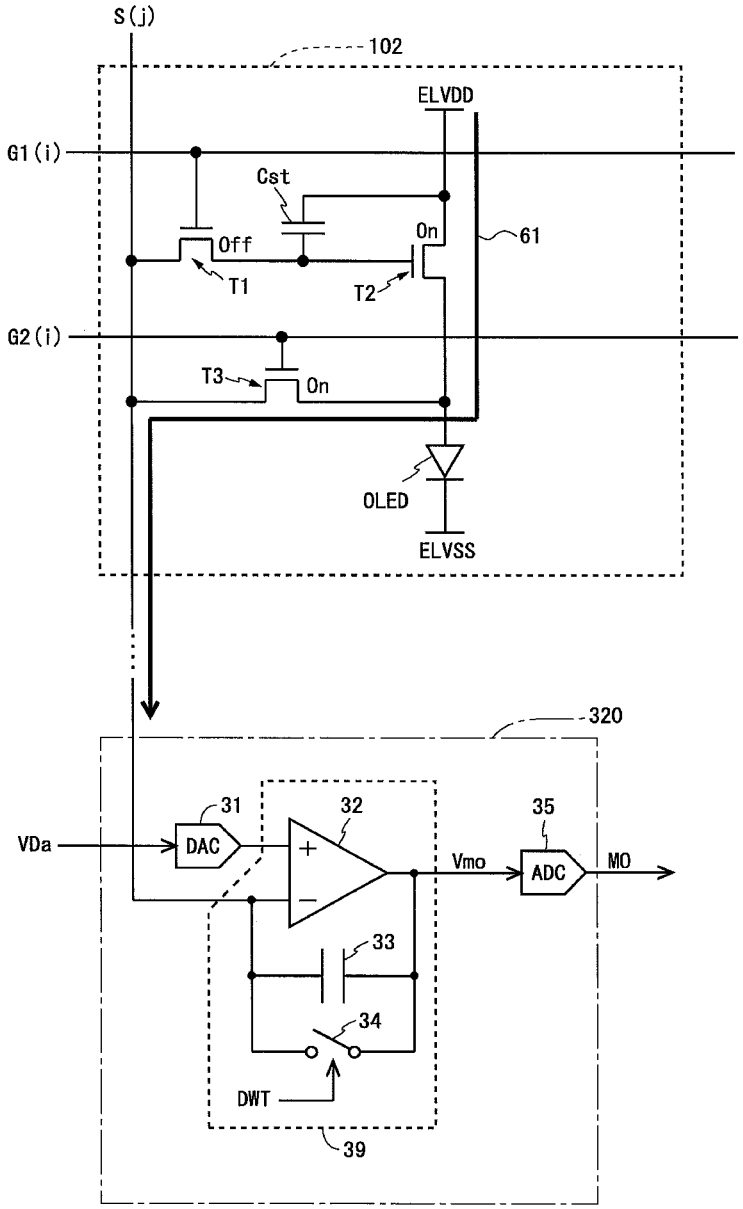
FIG. 5 is a diagram illustrating a current flow in a current measuring period in accordance with the embodiment.
Figure 6:
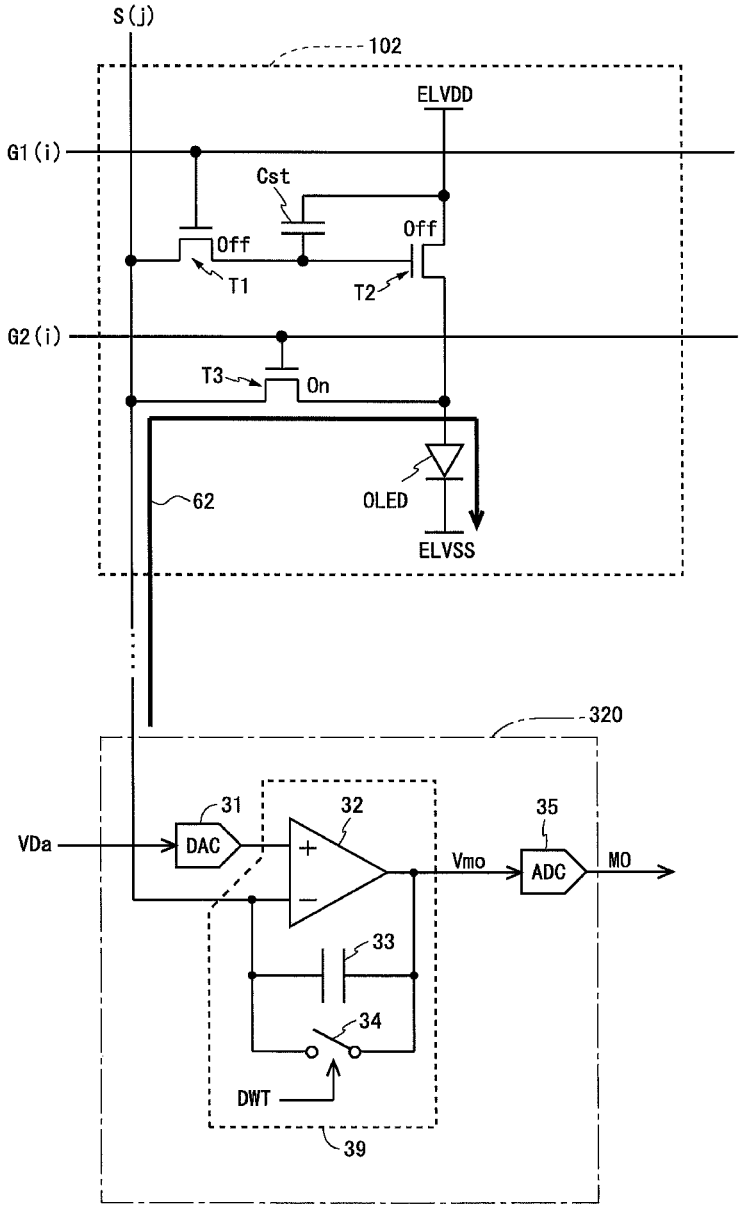
FIG. 6 is another diagram illustrating a current flow in a current measuring period in accordance with the embodiment.

Throughout the current measuring period Tb, the scan line G1(*i*) is inactive, and the monitoring control line G2(*i*) is active. Therefore, the transistor T1 is off, and the transistor T3 is on throughout the period. When the measuring voltage Vmg(i,j) is a TFT characteristics measuring voltage, the transistor T2 is on as described above, and there is no current flow in the organic EL element OLED. Consequently, the current flowing through the transistor T2 is outputted via the transistor T3 to the data line S(j) as indicated by an arrow 61 in FIG. 5. The current flowing in the data line S(j) is measured under these conditions by the current monitoring section 320 in the source driver 30. Meanwhile, when the measuring voltage Vmg(i,j) is an OLED characteristics measuring voltage, the transistor T2 is off as mentioned earlier, causing a current to flow in the organic EL element OLED. Specifically, a current flows from the data line S(j) to the organic EL element OLED via the transistor T3 as indicated by an arrow 62 in FIG. 6, causing the organic EL element OLED to emit light. The current flowing in the data line S(j) is measured under these conditions by the current monitoring section 320 in the source driver 30.

Figure 7:
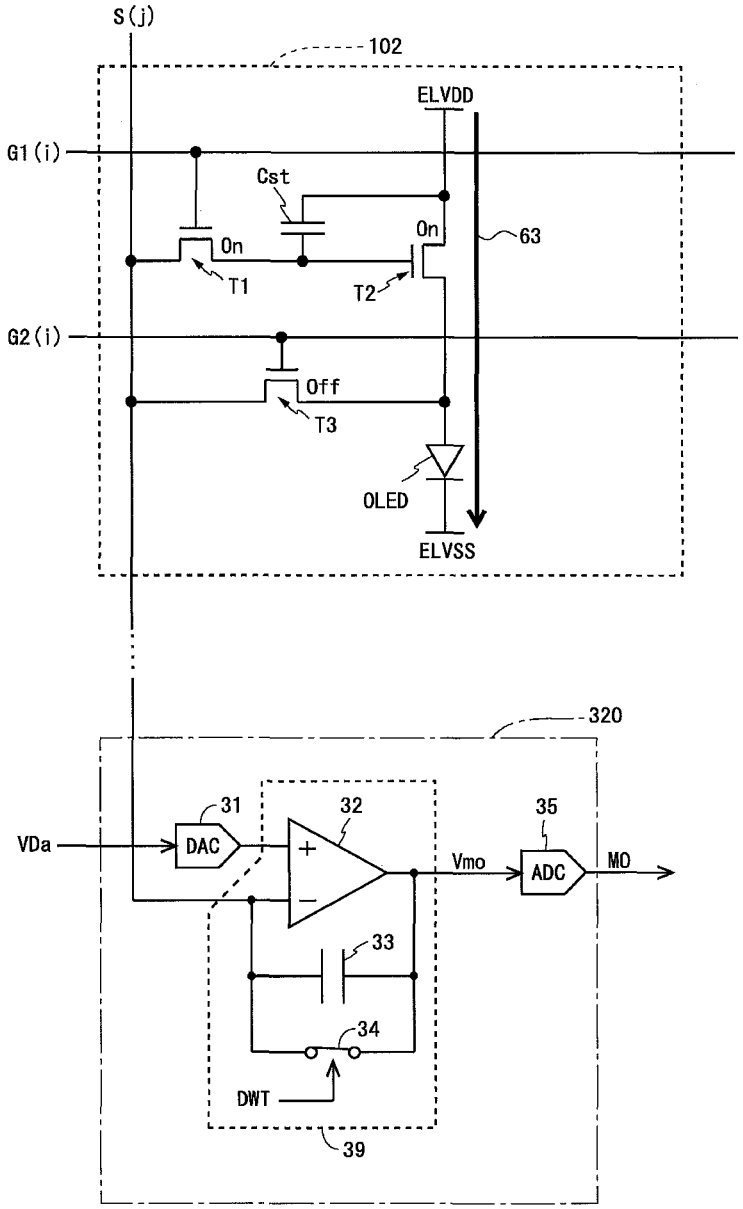
FIG. 7 is a diagram illustrating a current flow in a data voltage writing period in accordance with the embodiment.

In the data voltage writing period Tc, the scan line G1(*i*) is active, and the monitoring control line G2(*i*) is inactive. Therefore, the transistor T1 is on, and the transistor T3 is off. Also, in the data voltage writing period Tc, the data line S(j) is fed with a data voltage matched with a target luminance, thereby turning on the transistor T2. As a result, a drive current is supplied to the organic EL element OLED via the transistor T2 as indicated by an arrow 63 in FIG. 7, causing the organic EL element OLED to emit light at a luminance that matches the drive current.

4. PROCESSES CARRIED OUT BY CONTROL UNIT

Figure 8:
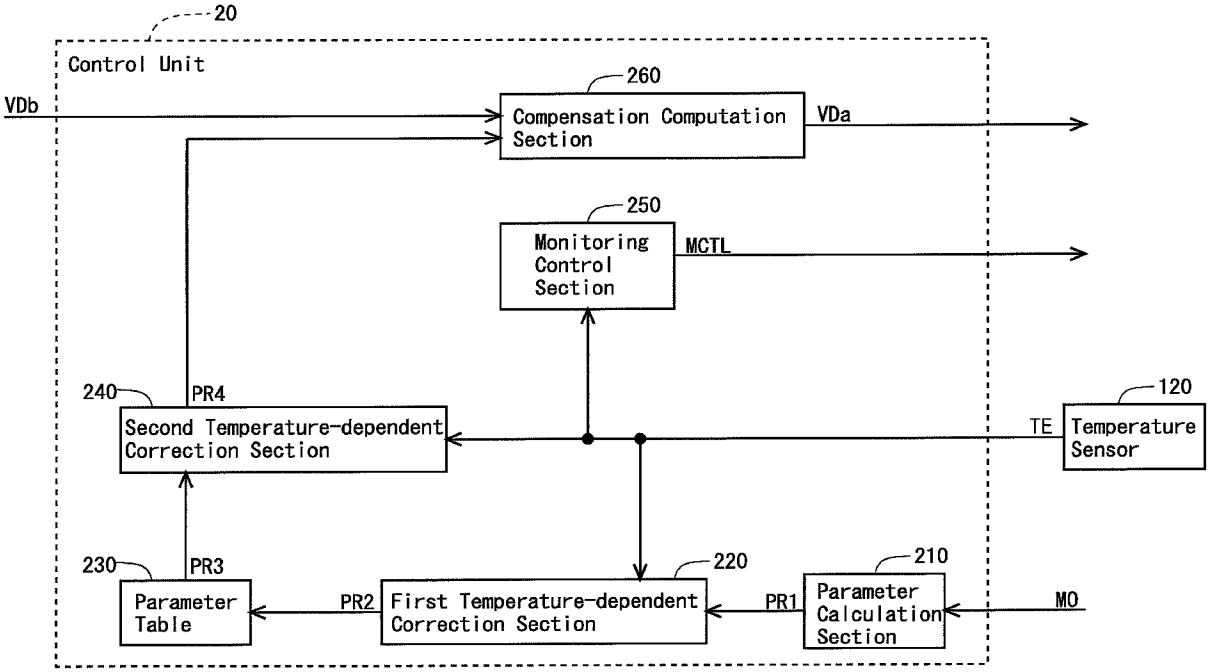
FIG. 8 is a detailed block diagram of an internal configuration of a control unit in accordance with the embodiment.

FIG. 8 is a detailed block diagram of an internal configuration of the control unit 20. The control unit 20 includes a parameter calculation section 210, a first temperature-dependent correction section 220, a parameter table 230, a second temperature-dependent correction section 240, a monitoring control section 250, and a compensation computation section 260. Each of these constituent elements may be provided either in the image processing section 22 or in the timing controller 24.

The monitoring data MO fed to the control unit 20 represents TFT or OLED characteristics. In the control unit 20, the externally provided image data VDb is subjected to compensation computation, using the values of compensation parameters ("parameter values") obtained from the monitoring data MO. To describe it in more detail, in the present embodiment, the parameter values are a TFT offset value that is an offset value (equivalent to a threshold voltage) obtained from results of detection of TFT characteristics, a TFT gain value that is a gain value obtained from results of detection of TFT characteristics, an OLED offset value that is an offset value (equivalent to a threshold voltage) obtained from results of detection of OLED characteristics, and an OLED degradation compensation coefficient that is a degradation compensation coefficient obtained from results of detection of OLED characteristics. In FIG. 8, the parameter values outputted from the parameter calculation section 210 are denoted by a reference sign "PR1," the parameter values outputted from the first temperature-dependent correction section 220 are denoted by a reference sign "PR2," the parameter values taken from the parameter table 230 are denoted by a reference sign "PR3," and the parameter values outputted from the second temperature-dependent correction section 240 are denoted by a reference sign "PR4."

The following will describe an operation of each of the constituent elements in FIG. 8. The parameter calculation section 210 calculates the parameter values PR1 from the monitoring data MO. The parameter calculation section 210 calculates a TFT offset value Vth_raw (TFT), a TFT gain value β_raw (TFT), an OLED offset value Vth_raw (OLED), and an OLED degradation compensation coefficient β_raw (OLED) as the parameter values PR1.

A specific example of a method of calculating these four parameter values will now be described. Current monitoring needs to be carried out four times for each of the pixel circuits 102 to determine these four parameter values. TFT characteristics are detected in the first and second rounds of current monitoring, whereas OLED characteristics are detected in the third and fourth rounds of current monitoring.

When the transistor T2 is operating in the saturation region, equation (1) below generally holds in an approximate manner for the gate-to-source voltage Vgs, drain current Id, threshold voltage Vth, and gain 3 of the transistor 2.

$$Id=(\beta/2)\times(Vgs-Vth)^2 \quad (1)$$

Letting Vgs1 and I1 respectively represent the gate-to-source voltage and measured current (the current measured by the current monitoring section 320) of the transistor T2 in the current measuring period Tb in the first round of current monitoring and further letting Vgs2 and I2 respectively represent the gate-to-source voltage and measured current of the transistor T2 in the current measuring period Tb in the second round of current monitoring, equations (2) and (3) hold because of equation (1).

$$I1=(\beta_\mathrm{raw}(TFT)/2)\times(Vgs1-Vth_\mathrm{raw}(TFT))^2 \quad (2)$$

$$I2=(\beta_\mathrm{raw}(TFT)/2)\times(Vgs2-Vth_\mathrm{raw}(TFT))^2 \quad (3)$$

Solving the system of equations (2) and (3), equations (4) and (5) are obtained.

[Math. 1]

$$\mathrm{Vth_raw}(TFT)=\frac{Vgs1\sqrt{I2}-Vgs2\sqrt{I1}}{\sqrt{I2}-\sqrt{I1}} \quad (4)$$

[Math. 2]

$$\beta_\mathrm{raw}(TFT)=\frac{2(\sqrt{I2}-\sqrt{I1})^2}{(Vgs2-Vgs1)^2} \quad (5)$$

Equation (6) below holds in an approximate manner for the anode-cathode voltage Vo, current Io, threshold voltage Vth, and gain β of the organic EL element OLED. Note that K is a constant from 2 to 3 inclusive.

$$Io=\beta(Vo-Vth)^K \quad (6)$$

Letting Vom3 and I3 respectively represent the anode-cathode voltage and measured current of the organic EL element OLED in the current measuring period Tb in the third round of current monitoring and further letting Vom4 and I4 respectively represent the anode-cathode voltage and measured current of the organic EL element OLED in the current measuring period Tb in the fourth round of current monitoring, equations (7) and (8) hold because of (6).

$$I3=\beta_\mathrm{raw}(\mathrm{OLED})\times(Vom3-Vth_\mathrm{raw}(\mathrm{OLED}))^K \quad (7)$$

$$I4=\beta_\mathrm{raw}(\mathrm{OLED})\times(Vom4-Vth_\mathrm{raw}(\mathrm{OLED}))^K \quad (8)$$

Solving the system of equations (7) and (8), equations (9) and (10) are obtained.

[Math. 3]

$$\mathrm{Vth_raw}(OLED)=\frac{Vom3\sqrt[K]{I4}-Vom4\sqrt[K]{I3}}{\sqrt[K]{I4}-\sqrt[K]{I3}} \quad (9)$$

[Math. 4]

$$\beta_\mathrm{raw}(OLED)=\frac{(\sqrt[K]{I4}-\sqrt[K]{I3})^K}{(Vom4-Vom3)^K} \quad (10)$$

As described in the foregoing, the parameter calculation section 210 calculates the TFT offset value Vth_raw (TFT) and the TFT gain value β_raw (TFT) from the monitoring data MO using equations (4) and (5). The parameter calculation section 210 further calculates the OLED offset value Vth_raw (OLED) and the OLED degradation compensation coefficient β_raw (OLED) from the monitoring data MO using equations (9) and (10).

The first temperature-dependent correction section 220 corrects (converts) the parameter values PR1 to those values which the parameters will take at standard temperature (e.g., 25°) on the basis of the temperature data TE. The parameter values PR2 obtained by the correction are stored in the parameter table 230. Related to this, for both the transistor and the organic EL element, the threshold voltage decreases with an increase in temperature. Therefore, for the TFT offset value and the OLED offset value, a value greater than that value which is calculated by the parameter calculation section 210 is stored in the parameter table 230 if the temperature at the time of monitoring (the temperature given by the temperature data TE) is higher than standard temperature, and a value smaller than the value calculated by the parameter calculation section 210 is stored in the parameter table 230 if the temperature at the time of monitoring is lower than standard temperature. In addition, the gain value of the transistor decreases with an increase in temperature. Therefore, for the TFT gain value, a value greater than that value which is calculated by the parameter calculation section 210 is stored in the parameter table 230 if the temperature at the time of monitoring is higher than standard temperature, and a value smaller than the value calculated by the parameter calculation section 210 is stored in the parameter table 230 if the temperature at the time of monitoring is lower than standard temperature. Additionally, the degradation compensation coefficient of the organic EL element increases with an increase in temperature. Therefore, for the OLED degradation compensation coefficient, a value smaller than that value which is calculated by the parameter calculation section 210 is stored in the parameter table 230 if the temperature at the time of monitoring is higher than standard temperature, and a value greater than the value calculated by the parameter calculation section 210 is stored in the parameter table 230 if the temperature at the time of monitoring is lower than standard temperature.

As described in the foregoing, the first temperature-dependent correction section 220 stores a TFT offset value Vth(TFT) obtained by the conversion of the TFT offset value Vth_raw (TFT) to a value at standard temperature, a TFT gain value β(TFT) obtained by the conversion of the TFT gain value β_raw (TFT) to a value at standard temperature, an OLED offset value Vth(OLED) obtained by the conversion of the OLED offset value Vth_raw (OLED) to a value at standard temperature, and an OLED degradation compensation coefficient β(OLED) obtained by the conversion of the OLED degradation compensation coefficient β_raw (OLED) to a value at standard temperature as the parameter values PR2 in the parameter table 230.

The parameter table 230 contains, for each pixel, the parameter values PR2 (the TFT offset value Vth(TFT), the TFT gain value β(TFT), the OLED offset value Vth(OLED), and the OLED degradation compensation coefficient β(OLED)) obtained by the first temperature-dependent correction section 220. The parameter table 230 provides a property data memory unit in the present embodiment.

The second temperature-dependent correction section 240 corrects (converts) the parameter values PR3 taken from the parameter table 230 to those values which the parameters will take at current temperature on the basis of the temperature data TE. The parameter values PR4 obtained by the correction are fed to the compensation computation section 260. Since the parameter table 230 contains parameter values associated with standard temperature (more specifically, parameter values obtained by converting the parameter values obtained at some temperature at the time of monitoring to those values which the parameters will take at standard temperature) as described above, the second temperature-dependent correction section 240 corrects parameter values such that the compensation computation section 260 can perform compensation computation that matches current temperature. In short, the second temperature-dependent correction section 240 performs correction in a manner opposite to the correction performed by the first temperature-dependent correction section 220. Taking a TFT offset value as an example, if the current temperature (temperature given by the temperature data TE) is higher than standard temperature, the compensation computation section 260 is given a value that is smaller than the value taken from the parameter table 230, and if the current temperature is lower than standard temperature, the compensation computation section 260 is given a value that is greater than the value taken from the parameter table 230. How the second temperature-dependent correction section 240 corrects the parameter values PR3 to obtain parameter values PR4 depends on how the compensation computation section 260 uses the parameter values PR4.

As described in the foregoing, the second temperature-dependent correction section 240 provides a TFT offset value Vth'(TFT) obtained by the conversion of the TFT offset value Vth(TFT) to a value at current temperature, a TFT gain value β'(TFT) obtained by the conversion of the TFT gain value β(TFT) to a value at current temperature, an OLED offset value Vth'(OLED) obtained by the conversion of the OLED offset value Vth(OLED) to a value at current temperature, and an OLED degradation compensation coefficient β'(OLED) obtained by the conversion of the OLED degradation compensation coefficient β(OLED) to a value at current temperature as the parameter values PR4 to the compensation computation section 260.

The monitoring control section 250 outputs a monitoring control signal MCTL on the basis of the temperature data TE. The contents of the monitoring control signal MCTL are reflected in the waveforms of signals that are parts of the gate control signal GCTL and the source control signal SCTL. This mechanism enables intervals at which the current monitoring section 320 measures current ("monitoring intervals") to be adjusted in accordance with temperature. This adjustment of monitoring intervals will be described next in detail in reference to FIGS. 9 and 10.

Figure 9:
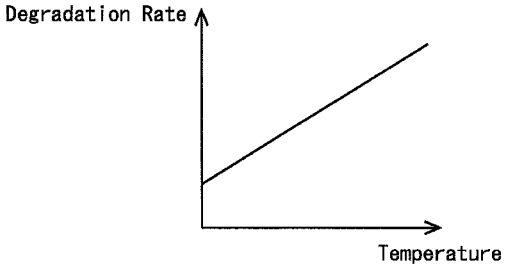
FIG. 9 is a graphical representation of a relationship between temperature and the degradation rate of a circuit element (transistor or organic EL element).

FIG. 9 is a graphical representation of a relationship between temperature and the degradation rate of a circuit element (transistor or organic EL element). As can be understood from FIG. 9, the circuit element exhibits a degradation rate that increases with an increase in temperature. Therefore, if two consecutive current monitoring timings for a row are separated by a long period at high temperature, the temperature-induced degradation of a circuit element may not be sufficiently compensated for. In other words, the difference between the ideal luminance and the luminance achieved through compensation computation ("compensation error") will increasingly likely exceed an acceptable range as temperature increases. An "acceptable range" in this context typically refers to such a range that the human eye cannot perceive luminance degradation.

Figure 10:
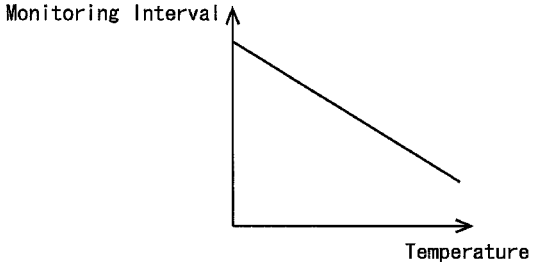
FIG. 10 is a graphical representation of a relationship between temperature and a monitoring interval in accordance with the embodiment.

Accordingly, in the present embodiment, the monitoring interval is decreased with an increase in temperature (in other words, the monitoring frequency is increased with an increase in temperature) as shown in FIG. 10 to prevent compensation error from growing beyond an acceptable range. In this manner, the monitoring control section 250 adjusts the monitoring interval such that the monitoring interval decreases with an increase in temperature and increases with a decrease in temperature. For example, at high temperature (60°), the transistor and the organic EL element degrade respectively at twice the rate and at four times the rate at normal temperature (25°) (the degradation rate can vary, for example, depending on the manufacturing process, composition, and driving conditions of the circuit element). The monitoring interval is determined considering these temperature-induced variations of the degradation rate of the circuit element.

In FIG. 10, the temperature-monitoring interval relationship is represented by a straight line. The degradation rate of a circuit element however will vary depending on various factors including the composition and manufacturing process of the circuit element. Therefore, it is preferable that a formula ("first relationship equation") that represents the temperature-monitoring interval relationship be prepared in advance through experiments and the monitoring interval be determined from the temperature data TE using the first relationship equation.

The compensation computation section 260 subjects the externally provided image data VDb to compensation computation on the basis of the parameter values PR4 outputted by the second temperature-dependent correction section 240 so as to compensate for the degradation of the circuit elements in the pixel circuits 102 (the drive transistors T2 and the organic EL elements OLED). The image data (digital video signal) VDa obtained by the compensation computation is outputted from the control unit 20 and transmitted to the source driver 30.

Figure 11:
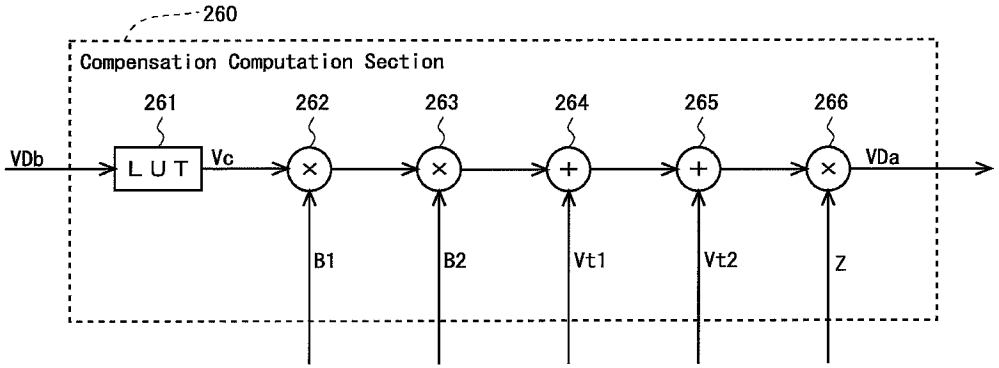
FIG. 11 is a block diagram of a configuration of a compensation computation section in accordance with the embodiment.

Now, in reference to FIG. 11, a description will be given of an example of the compensation computation performed by the compensation computation section 260. In this example, Vt1 denotes the TFT offset value Vth'(TFT), B1 denotes the TFT gain value β'(TFT). Vt2 denotes the OLED offset value Vth'(OLED), and B2 denotes the OLED degradation compensation coefficient β'(OLED). The compensation computation section 260 includes a LUT (lookup table) 261, a multiplication section 262, a multiplication section 263, an addition section 264, an addition section 265, and a multiplication section 266. The compensation computation section 260 is given a TFT gain value B1, an OLED degradation compensation coefficient B2, a TFT offset value Vt1, and an OLED offset value Vt2 as values of the compensation parameters. In this configuration, the externally provided image data (uncompensated image data) VDb is corrected as described next.

First, the uncompensated image data VDb is subjected to gamma correction using the LUT 261. Specifically, the gray level represented by the uncompensated image data VDb is converted to a control voltage Vc through gamma correction. The multiplication section 262 receives and multiplies the control voltage Vc and the TFT gain value B1 and then outputs a resultant value Vc·B1. The multiplication section 263 receives and multiplies the value Vc·B1 outputted from the multiplication section 262 and the OLED degradation compensation coefficient B2 and then outputs a resultant value Vc·B1·B2. The addition section 264 receives and adds the value Vc·B1·B2 outputted from the multiplication section 263 and the TFT offset value Vt1 and then outputs a resultant value Vc·B1·B2+Vt1. The addition section 265 receives and adds the value Vc·B1·B2+Vt1 outputted from the addition section 264 and the OLED offset value Vt2 and then outputs a resultant value Vc·B1·B2+Vt1+Vt2. The multiplication section 266 receives and multiplies the value Vc·B1·B2+Vt1+Vt2 outputted from the addition section 265 and a coefficient Z for compensating for a decay of data voltage caused by the parasitic capacitance of the pixel circuit 102 and then outputs a resultant value Z(Vc·B1·B2+Vt1+Vt2). Data having the value Z(Vc·B1·B2+Vt1+Vt2) obtained in this manner is outputted from the compensation computation section 260 as the compensated image data (digital video signal) VDa. This process is a mere example, which by no means limits the scope of the present invention.

5. EFFECTS

Figure 12:
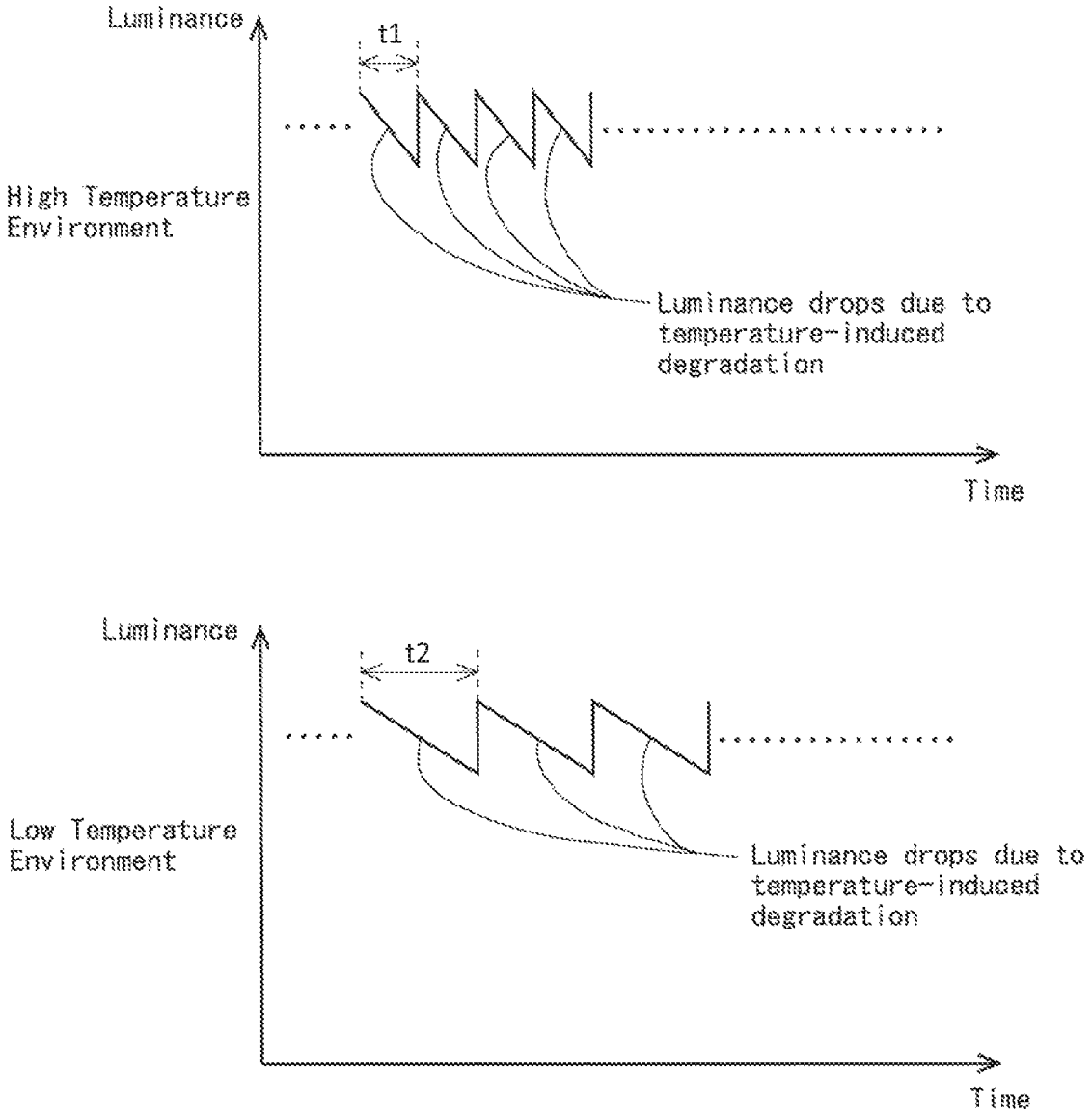
FIG. 12 is a graphical representation of effects of the embodiment.
Figure 13:
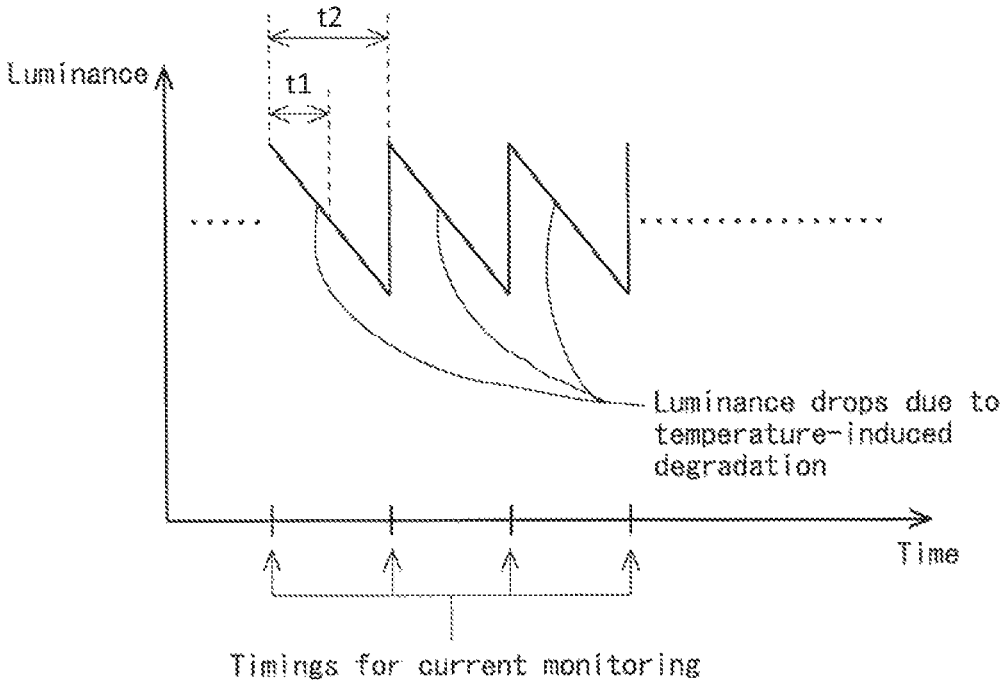
FIG. 13 is another graphical representation of effects of the embodiment.

The present embodiment provides an organic EL display device that has a function of compensating for degradation of circuit elements (drive transistors T2 and organic EL elements OLED). The organic EL display device includes the temperature sensor 120 that senses temperature and the monitoring control section 250 that adjusts monitoring intervals in accordance with sensed temperature. The monitoring control section 250 adjusts monitoring intervals such that the monitoring interval decreases with an increase in temperature and increases with a decrease in temperature. This configuration restrains luminance from decreasing due to temperature-induced degradation even when the organic EL display device is being used at high temperature. This will be described further in reference to FIGS. 12 and 13. FIG. 12 illustrates a relationship between time and luminance at high and low temperature in accordance with the present embodiment. As shown in FIG. 12, a high-temperature monitoring interval t1 is shorter than a low-temperature monitoring interval t2. If the monitoring interval at high temperature is equal to T2, the passage of time and luminance have a relationship shown in FIG. 13. From FIG. 13, it can be appreciated that the luminance achieved through compensation computation is much lower immediately before current monitoring is performed than the ideal luminance. In contrast, according to the present embodiment, the monitoring frequency is increased at high temperature, which restrains luminance from decreasing due to temperature-induced degradation as shown in FIG. 12. In addition, although power consumption increases with an increasing monitoring frequency, the present embodiment lowers the monitoring frequency at low temperature. That restrains power consumption from increasing due to current monitoring. In this manner, the present embodiment provides an organic EL display device capable of restraining luminance from decreasing due to temperature-induced degradation (falling light emission efficiency) of the organic EL elements OLED without entailing significant increase in power consumption.

The temperature sensor 120 is disposed inside the organic EL panel 10 in the present embodiment. Therefore, in comparison with a configuration where the temperature sensor is provided outside the organic EL panel, the temperature sensor 120 is capable of sensing temperature close to the circuit element, which improves precision of compensation. A configuration in which there is provided a plurality of temperature sensors 120 may enable sufficient compensation for degradation of circuit elements regardless of where in the organic EL panel 10 the temperature sensors 120 are located.

6. VARIATION EXAMPLES

The following will describe variation examples of the embodiment described above.

6.1 First Variation Example

Figure 14:
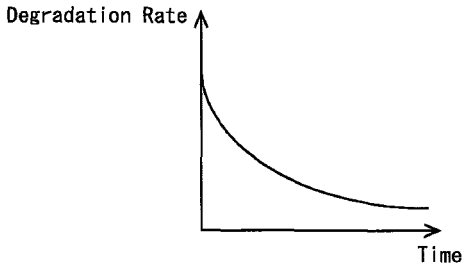
FIG. 14 is a graphical representation of a relationship between time and the degradation rate of a circuit element.
Figure 15:
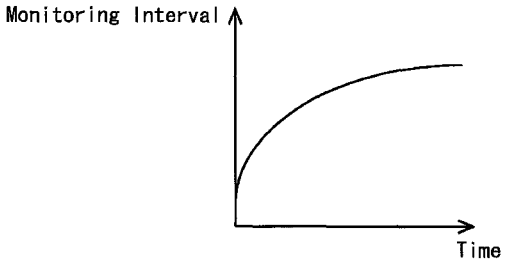
FIG. 15 is a graphical representation of a relationship between time and a monitoring interval in accordance with a first variation example of the embodiment.

FIG. 14 is a graphical representation of a relationship between time and the degradation rate of a circuit element (transistor or organic EL element). As can be understood from FIG. 14, the degradation rate of the circuit element decreases with time. In other words, the circuit element degrades rapidly at the initial time. Accordingly in the present variation example, the monitoring interval is determined considering the cumulative drive time of the pixel circuit 102 as well as temperature. For example, as shown in FIG. 15, the monitoring interval is initially set to a low value and gradually increased with passage of time. A description will be given of a configuration that implements this variation example.

Figure 16:
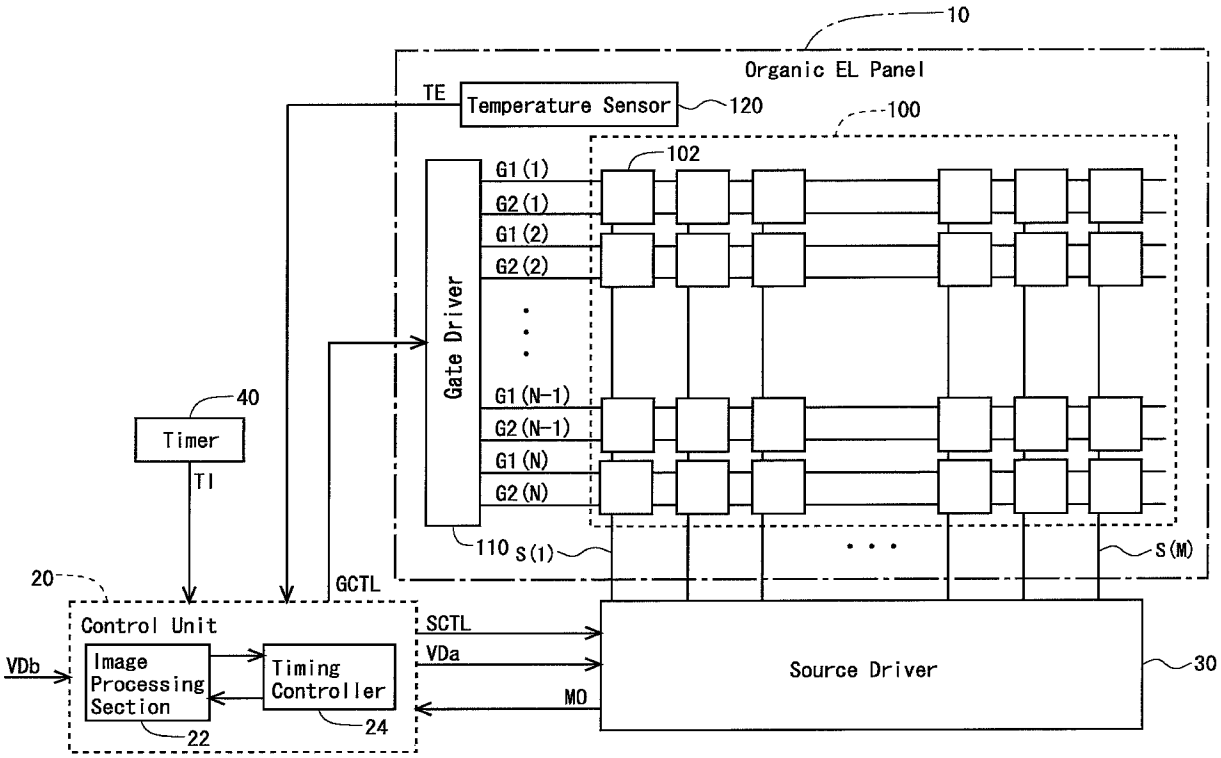
FIG. 16 is a block diagram of an overall configuration of an active-matrix organic EL display device in accordance with the first variation example.

FIG. 16 is a block diagram of an overall configuration of an active-matrix organic EL display device in accordance with the present variation example. The organic EL display device in accordance with the present variation example includes a timer 40 in addition to the same constituent elements (see FIG. 1) as those in the embodiment described above. The timer 40 provides a cumulative drive time measurement unit. The timer 40 measures the cumulative operating time of the organic EL display device (i.e., the cumulative drive time of the pixel circuit 102) and feeds time data TI representing the cumulative drive time to the control unit 20. The control unit 20 receives the externally provided image data VDb, the monitoring data MO outputted from the source driver 30, the temperature data TE outputted from the temperature sensor 120, and the time data TI outputted from the timer 40 and subjects the image data VDb to compensation computation on the basis of the monitoring data MO, the temperature data TE, and the time data TI to generate the digital video signal (compensated image data) VDa which will be fed to the source driver 30. The constituent elements otherwise operate in the same manner as in the embodiment described above, and description thereof is omitted.

Figure 17:
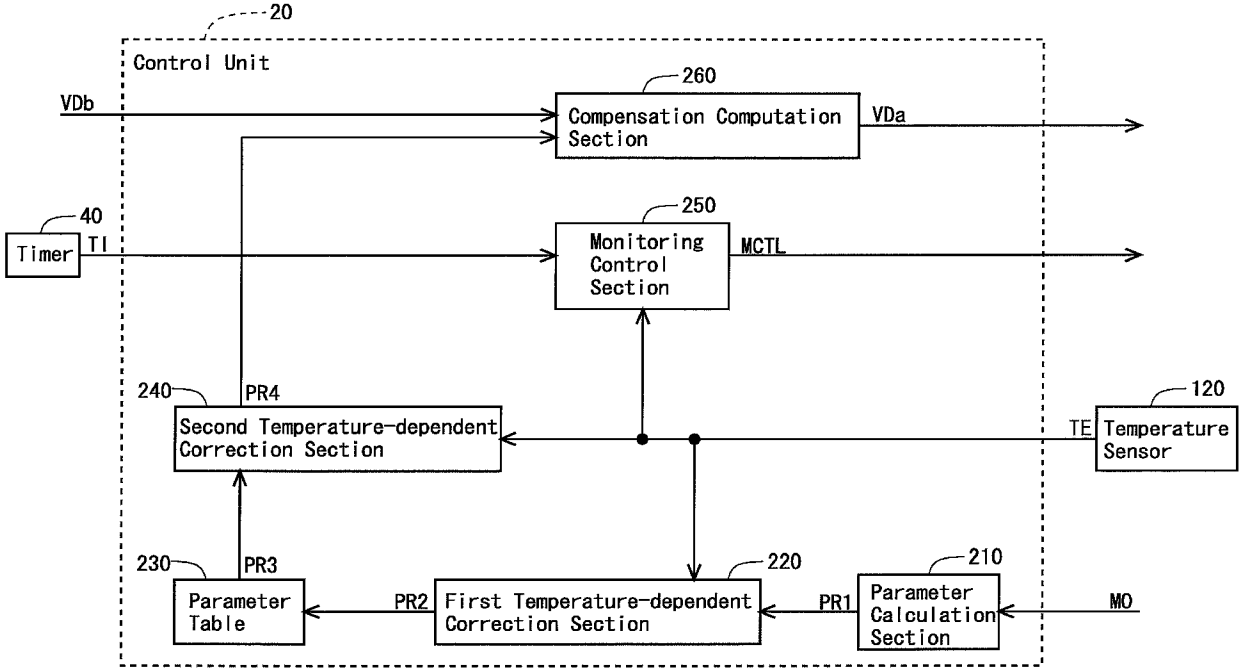
FIG. 17 is a detailed block diagram of an internal configuration of a control unit in accordance with the first variation example.

FIG. 17 is a detailed block diagram of an internal configuration of the control unit 20 in accordance with the present variation example. The monitoring control section 250, in the present variation example, outputs the monitoring control signal MCTL on the basis of the temperature data TE and the time data TI. This configuration enables the monitoring interval to be adjusted in accordance with temperature and the cumulative drive time of the pixel circuit 102. More specifically, the monitoring interval is adjusted so as to decrease with an increase in temperature and increase with a decrease in temperature and also to decrease with a shorter cumulative drive time and increase with a longer cumulative drive time.

The degradation rate of a circuit element will vary depending on various factors including the material and manufacturing process of the circuit element. It is therefore preferable that an equation ("second relationship equation") be prepared in advance that represents the relationship between the cumulative drive time and the monitoring interval and the monitoring interval be determined on the basis of the time data TI using the second relationship equation.

According to the present variation example, the organic EL display device is provided with the timer 40 for measurement of the cumulative drive time of the pixel circuit 102. The monitoring interval is determined considering the cumulative drive time of the pixel circuit 102 as well as temperature. More specifically, the monitoring control section 250 adjusts the monitoring interval such that the monitoring interval decreases with an increase in temperature and increases with a decrease in temperature and also that the monitoring interval decreases with a shorter cumulative drive time and increases with a longer cumulative drive time. Therefore, the monitoring interval is more suitably determined in accordance with the cumulative drive time. These features can more effectively restrain luminance from decreasing due to temperature-induced degradation (falling light emission efficiency) of the organic EL elements OLED while more effectively suppressing increases in power consumption.

6.2 Second Variation Example

Figure 18:
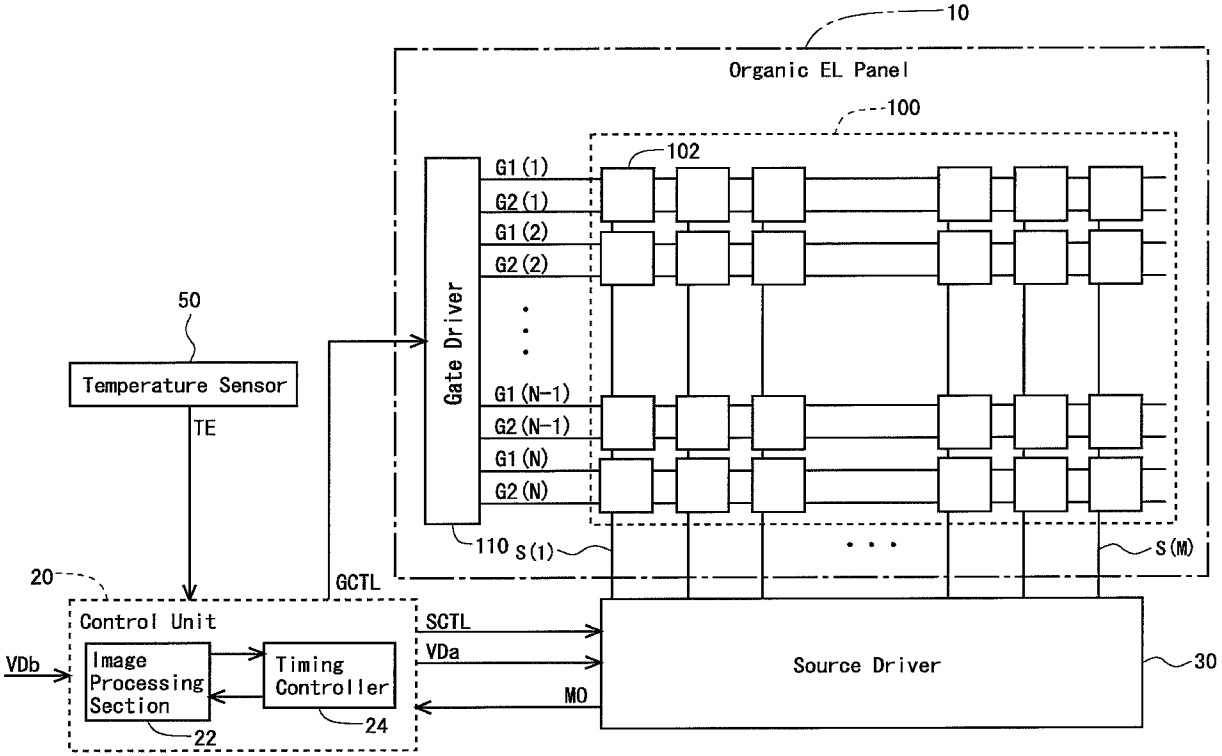
FIG. 18 is a block diagram of an overall configuration of an active-matrix organic EL display device in accordance with a second variation example of the embodiment.

FIG. 18 is a block diagram of an overall configuration of an active-matrix organic EL display device in accordance with a second variation example of the embodiment described earlier. The temperature sensor 120, in the embodiment described earlier, is disposed inside the organic EL panel 10. In contrast, in the present variation example, a temperature sensor 50 is disposed outside the organic EL panel 10. The temperature sensor 50 in the present variation example also senses its ambient temperature and outputs temperature data TE that represents the sensed temperature. The temperature data TE is fed to the control unit 20. The present variation example is the same as the embodiment described earlier, except for the location of the temperature sensor 50.

According to the present variation example, the temperature sensor 50 may be a common sensor. In addition, the organic EL panel 10 may have a conventional configuration with no modifications. In other words, an existing organic EL panel may be used. Therefore, the present variation example is capable of lowering cost over the embodiment described earlier.

6.3 Third Variation Example

In the embodiment described earlier, the organic EL display device includes the source driver 30 which has a function of measuring the currents outputted from the pixel circuits 102 to the data lines S(1) to S(M). In other words, currents are measured to monitor characteristics of circuit elements (drive transistors T2 and organic EL elements OLED) in the pixel circuits 102. The present invention however is by no means limited to such a configuration. Alternatively, voltages may be measured to monitor characteristics of the circuit elements in the pixel circuits 102, which is the configuration for the present variation example.

Figure 19:
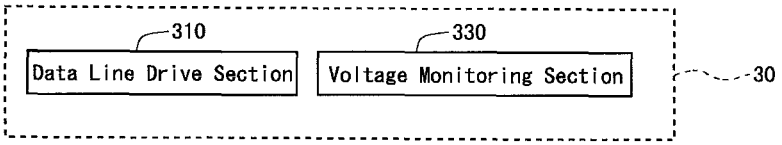
FIG. 19 is a functional block diagram of a source driver in accordance with a third variation example of the embodiment.

FIG. 19 is a functional block diagram of a source driver 30 in accordance with the present variation example. As shown in FIG. 19, the source driver 30 in the present variation example includes, in functional terms, a data line drive section 310 that drives the data lines S(1) to S(M) and a voltage monitoring section 330 that measures voltage at prescribed locations on the data lines S(1) to S(M).

Figure 20:
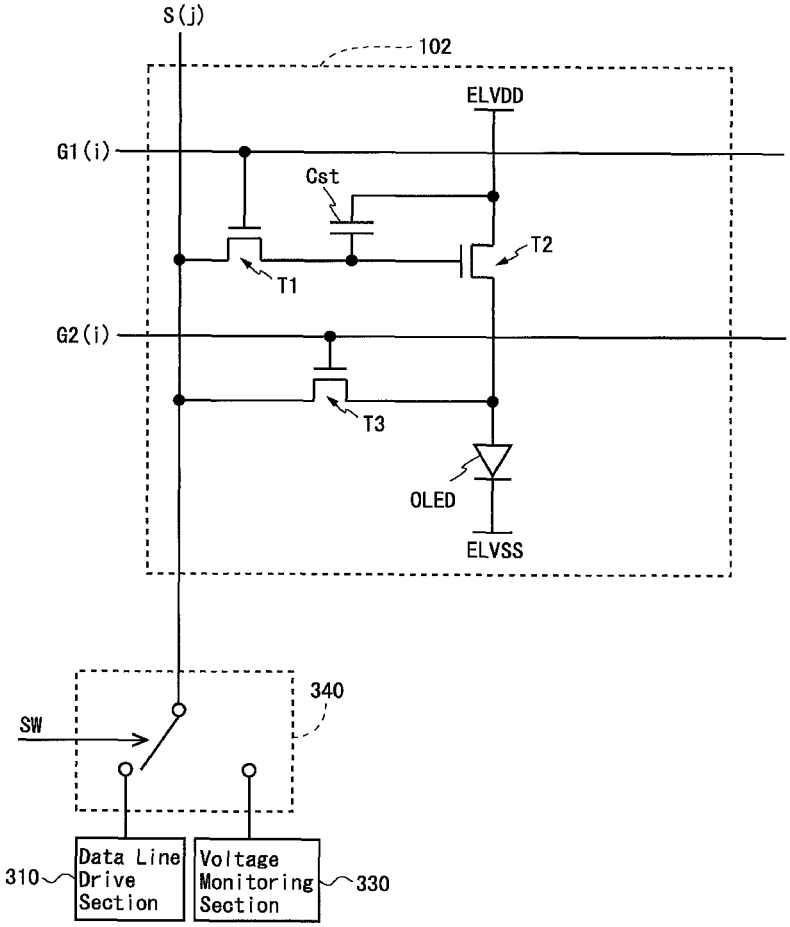
FIG. 20 is a circuit diagram of a pixel circuit and a part of the source driver in accordance with the third variation example.

FIG. 20 is a circuit diagram of a pixel circuit 102 and a part of the source driver 30. FIG. 20 shows one of the pixel circuits 102 located at the intersection of the i-th row and the j-th column and a part of the source driver 30 that corresponds to the data line S(j) in the j-th column. In the present variation example, there is provided a switching section 340 that, as shown in FIG. 20, connects the data line S(j) in a switchable manner to the data line drive section 310 and the voltage monitoring section 330. The data line S(j) is connected to either the data line drive section 310 or the voltage monitoring section 330 in response to a switching control signal SW supplied from the control unit 20 to the switching section 340.

Figure 21:
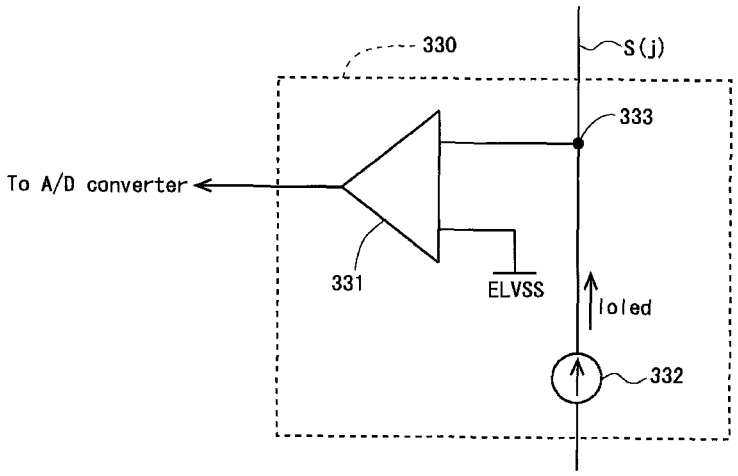
FIG. 21 is a diagram of an example configuration of a voltage monitoring section in accordance with the third variation example.

FIG. 21 is a diagram of an example configuration of the voltage monitoring section 330. As shown in FIG. 21, the voltage monitoring section 330 includes an amplifier 331 and a constant current source 332. The amplifier 331, in this configuration, amplifies the voltage between an electrode having the low-level power supply voltage ELVSS and a node 333, with the constant current source 332 supplying a constant current Ioled to the data line S(j). The amplified voltage is fed to an A/D converter where A/D conversion takes place to generate digital data that is fed to the control unit 20 as the monitoring data MO.

Figure 22:
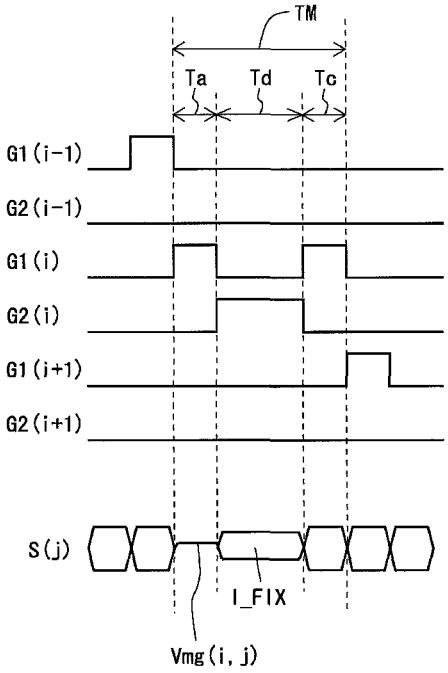
FIG. 22 is a timing chart depicting a driving method for voltage monitoring in accordance with the third variation example.
Figure 23:
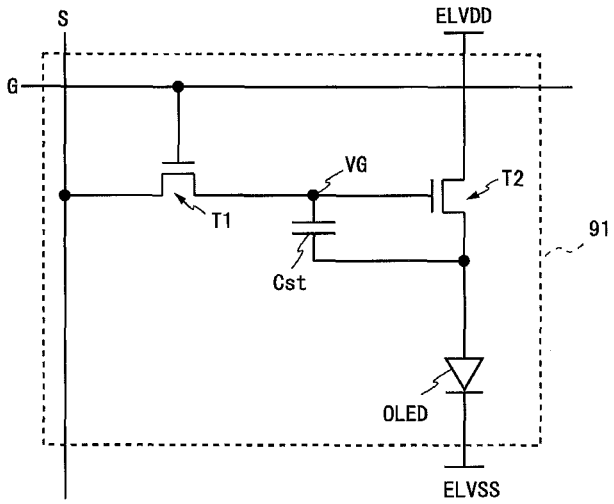
FIG. 23 is a circuit diagram of a configuration of a conventional, typical pixel circuit.
Figure 24:
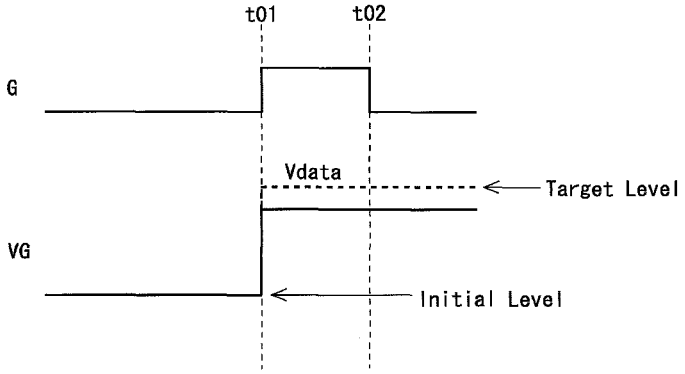
FIG. 24 is a timing chart depicting an operation of the pixel circuit shown in FIG. 23.
Figure 25:
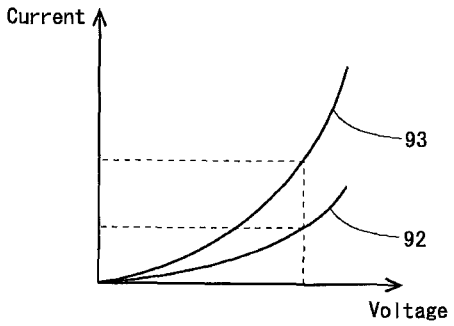
FIG. 25 is a graphical representation of the voltage-current characteristics of an organic EL element.
Figure 26:
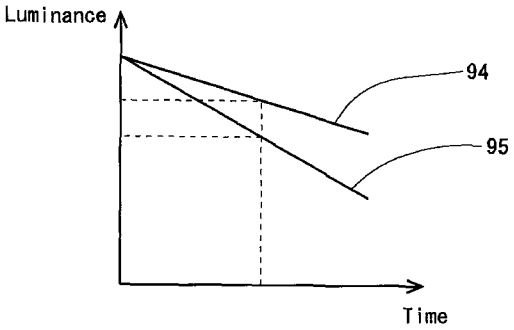
FIG. 26 is a graph prepared for the purpose of discussion of a long-term property of an organic EL element.

FIG. 22 is a timing chart depicting a driving method for voltage monitoring (voltage measurement performed to detect TFT and OLED characteristics) in accordance with the present variation example. FIG. 22 shows an example where voltage is monitored on the i-th row. Each monitoring period TM includes a detection preparation period Ta, a voltage measuring period Td in which voltages are measured to detect characteristics, and a data voltage writing period Tc.

Throughout the detection preparation period Ta, the scan line G1(*i*) is active, and the monitoring control line G2(*i*) is inactive. Therefore, the transistor T1 is on, and the transistor T3 is off, throughout the period. In the detection preparation period Ta, the measuring voltage Vmg(i,j) is applied to the data line S(j). The measuring voltage Vmg(i,j) is either a TFT characteristics measuring voltage or an OLED characteristics measuring voltage. If the measuring voltage Vmg(i,j) is a TFT characteristics measuring voltage, the transistor T2 is on; if the measuring voltage Vmg(i,j) is an OLED characteristics measuring voltage, the transistor T2 is off.

Similarly to the embodiment described earlier, the TFT characteristics measuring voltage applied to the data line S(j) in the detection preparation period Ta is set to satisfy TFT Characteristics Measuring Voltage<Threshold Voltage of Organic EL element OLED+Threshold Voltage of Transistor T2. Meanwhile, the OLED characteristics measuring voltage applied to the data line S(j) in the detection preparation period Ta is set to satisfy OLED Characteristics Measuring Voltage<Threshold Voltage of Organic EL Element OLED+Threshold Voltage of Transistor T2.

Throughout the voltage measuring period Td, the scan line G1(*i*) is inactive, and the monitoring control line G2(*i*) is active. Therefore, the transistor T1 is off, and the transistor T3 is on, throughout the period. A constant current I_FIX is fed to the data line S(j) in this state. The constant current I_FIX flows from the pixel circuit 102 to the source driver 30 in the measurement of TFT characteristics and from the source driver 30 to the pixel circuit 102 in the measurement of OLED characteristics. If a TFT characteristics measuring voltage is being applied to the data line S(j) in the detection preparation period Ta, a current that flows through the transistors T2 and T3 from the electrode having the high-level power supply voltage ELVDD flows toward the data line S(j). If an OLED characteristics measuring voltage is being applied to the data line S(j) in the detection preparation period Ta, a current that flows through the transistor T3 and the organic EL element OLED from the data line S(j) flows to the electrode having the low-level power supply voltage ELVSS. The voltage monitoring section 330 in the source driver 30 measures voltage at a prescribed location on the data line S(j) (node 333 in FIG. 21) in the voltage measuring period Td.

Throughout the data voltage writing period Tc, the scan line G1(*i*) is active, and the monitoring control line G2(*i*) is inactive. Therefore, the transistor T1 is on, and the transistor T3 is off, throughout the period. In addition, a data voltage is applied to the data line S(j) in accordance with a target luminance in the data voltage writing period Tc. Thus, the transistor T2 is on. As a result, a drive current is supplied to the organic EL element OLED via the transistor T2, and the organic EL element OLED emits light at a luminance that corresponds to the drive current.

As described in the foregoing, TFT and OLED characteristics can be monitored similarly to earlier cases when voltage, in place of current, is measured to perform compensation computation. The image data VDb can be subjected to compensation computation on the basis of the acquired information. In the organic EL display device in which voltage is measured for compensation computation, these features can restrain luminance from decreasing due to temperature-induced degradation (falling light emission efficiency) of the organic EL elements OLED without entailing significant increase in power consumption.

7. MISCELLANEOUS

The present invention is by no means limited to the embodiment and variation examples given above and may be practiced with various modifications without departing from the scope of the present invention. For example, the embodiment and variation examples above describe an organic EL display device as an example. The present invention may however be applied to any display device that includes current-driven, self light-emitting display elements, as well as to the organic EL display device.

In the embodiment and variation examples, the pixel circuit 102 (see FIG. 3) includes n-channel transistors, but may alternatively include p-channel transistors.

The present application hereby claims priority to Japanese Patent Application No. 2015-242848 filed Dec. 14, 2015, titled "Display Device and Method of Driving Same," the entire contents of which are incorporated herein by reference.

REFERENCE SIGNS LIST

10 Organic EL Panel
20 Control Unit
30 Source Driver
50, 120 Temperature Sensor
100 Display Unit
102 Pixel Circuit
110 Gate Driver
210 Parameter Calculation Section
220 First Temperature-dependent Correction Section
230 Parameter Table
240 Second Temperature-dependent Correction Section
250 Monitoring Control Section
260 Compensation Computation Section
310 Data Line Drive Section
320 Current Monitoring Section
330 Voltage Monitoring Section
T1 to T3 Transistor
Cst Capacitor
OLED Organic EL Element
G1(1) to G1(N) Scan Line
G2(1) to G2(N) Monitoring Control Line
S(1) to S(M) Data Line
MCTL Monitoring Control Signal
MO Monitoring Data
TE Temperature Data
TI Time Data

The invention claimed is:

1. A display device including a plurality of pixel circuits each including, as circuit elements: an electro-optical element having a current-controlled luminance; and a drive transistor for controlling a current to be fed to the electro-optical element, said display device comprising:

a pixel circuit drive unit configured to perform a property measuring process in which a property of the circuit elements is measured and a drive process in which the pixel circuits are driven;

a property data memory unit configured to store property data obtained from a result of measurement performed in the property measuring process;

a compensation computation unit configured to correct an input video signal based on the property data stored in the property data memory unit, so as to generate a video signal to be fed to the pixel circuits;

at least one temperature sensing unit configured to sense temperature; and a measurement controlling unit configured to control an execution frequency of the property measuring process in accordance with a temperature sensed by the at least one temperature sensing unit; and a cumulative drive time measurement unit configured to measure a cumulative drive time of the pixel circuits, wherein the measurement controlling unit increases the execution frequency of the property measuring process with an increase in the sensed temperature and increases execution intervals of the property measuring process with an increase in the cumulative drive time.

2. The display device according to claim 1, wherein the measurement controlling unit stores in advance a first relationship equation representing a relationship between temperature and the execution frequency of the property measuring process, so that the execution frequency of the property measuring process is determined based on the sensed temperature using the first relationship equation.

3. The display device according to claim 1, wherein the measurement controlling unit stores in advance a second relationship equation representing a relationship between the cumulative drive time and the execution frequency of the property measuring process, so that the execution frequency of the property measuring process is determined based on the cumulative drive time using the second relationship equation.

4. The display device according to claim 1, further comprising:

first property data correction circuitry configured to correct a value of the property data obtained from the result of measurement performed in the property measuring process to a value associated with standard temperature based on a temperature sensed in the property measuring process by the at least one temperature sensing unit, so as to store corrected property data in the property data memory unit; and second property data correction circuitry configured to correct a value of the property data stored in the property data memory unit to a value associated with a temperature sensed in the drive process by the at least one temperature sensing unit, wherein the compensation computation unit corrects the input video signal based on property data corrected by the second property data correction circuitry, so as to generate a video signal to be fed to the pixel circuits.

5. The display device according to claim 1, wherein the at least one temperature sensing unit comprises a plurality of temperature sensing units.

6. The display device according to claim 1, wherein the at least one temperature sensing unit is disposed inside a display panel containing the pixel circuits.

7. The display device according to claim 1, wherein the at least one temperature sensing unit is disposed outside a display panel containing the pixel circuits.

8. The display device according to claim 1, wherein the electro-optical element is an organic light-emitting diode.

9. A method of driving a display device including a plurality of pixel circuits each including, as circuit elements: an electro-optical element having a current-controlled luminance; and a drive transistor for controlling a current to be fed to the electro-optical element, said method comprising:

the pixel circuit driving step of driving the pixel circuits while performing a property measuring process in which a property of the circuit elements is measured;

the property data storing step of storing property data obtained from a result of measurement performed in the property measuring process in a prescribed property data memory unit;

the compensation computing step of correcting an input video signal based on the property data stored in the property data memory unit, so as to generate a video signal to be fed to the pixel circuits;

the temperature sensing step of sensing temperature; and the measurement controlling step of controlling an execution frequency of the property measuring process in accordance with a temperature sensed in the temperature sensing step; and the cumulative drive time measurement step of measuring a cumulative drive time of the pixel circuits, wherein the measurement controlling step increases the execution frequency of the property measuring process with an increase in the sensed temperature and increases execution intervals of the property measuring process with an increase in the cumulative drive time.

10. A display device including a plurality of pixel circuits each including, as circuit elements: an electro-optical element having a current-controlled luminance; and a drive transistor for controlling a current to be fed to the electro-optical element, said display device comprising:

a pixel circuit drive unit configured to perform a property measuring process in which a property of the circuit elements is measured and a drive process in which the pixel circuits are driven;

a property data memory unit;

at least one temperature sensing unit configured to sense temperature;

first property data correction circuitry configured to correct a value of property data obtained from a result of measurement performed in the property measuring process to a value associated with standard temperature based on a temperature sensed in the property measuring process by the at least one temperature sensing unit, so as to store corrected property data in the property data memory unit;

second property data correction circuitry configured to correct a value of the property data stored in the property data memory unit to a value associated with a temperature sensed in the drive process by the at least one temperature sensing unit; and a compensation computation unit configured to correct an input video signal based on the property data corrected by the second property data correction circuitry, so as to generate a video signal to be fed to the pixel circuits; and a cumulative drive time measurement unit configured to measure a cumulative drive time of the pixel circuits, wherein an execution frequency of the property measuring process is increased with an increase in a temperature sensed by the at least one temperature sensing unit and execution intervals of the property measuring process are increased with an increase in the cumulative drive time.

11. The display device according to claim 10, wherein the at least one temperature sensing unit comprises a plurality of temperature sensing units.

12. The display device according to claim 10, wherein the at least one temperature sensing unit is disposed inside a display panel containing the pixel circuits.

13. The display device according to claim 10, wherein the at least one temperature sensing unit is disposed outside a display panel containing the pixel circuits.

14. The display device according to claim 10, wherein the electro-optical element is an organic light-emitting diode.

15. The display device according to claim 4, wherein the property data includes an offset value of the drive transistor and a gain value of the drive transistor, when the sensed temperature at the time of execution of the property measuring process is higher than the standard temperature, the first property data correction circuitry stores in the property data memory unit the offset value greater than a value that is obtained from the result of measurement performed in the property measuring process and stores in the property data memory unit the gain value greater than a value that is obtained from the result of measurement performed in the property measuring process, and when the sensed temperature at the time of execution of the property measuring process is lower than the standard temperature, the first property data correction circuitry stores in the property data memory unit the offset value smaller than a value that is obtained from the result of measurement performed in the property measuring process and stores in the property data memory unit the gain value smaller than a value that is obtained from the result of measurement performed in the property measuring process.

16. The display device according to claim 4, wherein the property data includes an offset value of the electro-optical element and a degradation compensation coefficient of the electro-optical element, when the sensed temperature at the time of execution of the property measuring process is higher than the standard temperature, the first property data correction circuitry stores in the property data memory unit the offset value greater than a value that is obtained from the result of measurement performed in the property measuring process and stores in the property data memory unit the degradation compensation coefficient smaller than a value that is obtained from the result of measurement performed in the property measuring process, and when the sensed temperature at the time of execution of the property measuring process is lower than the standard temperature, the first property data correction circuitry stores in the property data memory unit the offset value smaller than a value that is obtained from the result of measurement performed in the property measuring process and stores in the property data memory unit the degradation compensation coefficient greater than a value that is obtained from the result of measurement performed in the property measuring process.

* * * * *